US009511903B2

(12) United States Patent
Hurst et al.

(10) Patent No.: US 9,511,903 B2
(45) **Date of Patent: *Dec. 6, 2016**

(54) COVERING, PROTECTING, AND POSITIONING A PORTABLE ELECTRONIC DEVICE

(71) Applicant: NewFlux, LLC, Centerville, UT (US)

(72) Inventors: Jared Hurst, Centerville, UT (US); Troy A. Holbrook, Holladay, UT (US); Steven R. Hutchinson, Highland, UT (US); Tyson Triplett, Provo, UT (US)

(73) Assignee: Newflux, LLC, Centerville ( * ) Notice: Subject to any disclaimer, the term of this patent is extended or adjusted under 35 U.S.C. 154(b) by 0 days.

This patent is subject to a terminal disclaimer.

(21) Appl. No.: 14/819,176

(22) Filed: Aug. 5, 2015

(65) Prior Publication Data

US 2016/0001928 A1 Jan. 7, 2016

Related U.S. Application Data

(63) Continuation of application No. 14/098,387, filed on Dec. 5, 2013, now Pat. No. 9,131,756.

(60) Provisional application No. 61/733,856, filed on Dec. 5, 2012, provisional application No. 61/768,996, filed on Feb. 25, 2013.

(51) Int. Cl.

| | |
|---|---|
| ***B65D 25/24*** | (2006.01) |
| ***A45C 11/00*** | (2006.01) |
| ***A45C 13/10*** | (2006.01) |

(52) U.S. Cl.

CPC ..... *B65D 25/24* (2013.01); *A45C 11/00* (2013.01); *A45C 13/1069* (2013.01); *A45C 2011/003* (2013.01); *A45C 2200/15* (2013.01); *Y10T 29/49826* (2015.01)

(58) Field of Classification Search

CPC ..... A45C 11/00; A45C 13/1069; A45C 2011/003; A45C 2200/15; G06F 1/16; G06F 1/1626; G06F 1/1628; G06F 1/1656; Y10T 29/49826

USPC ..... 206/45.2, 45.23, 45.24, 320; 248/455, 248/458; 361/679.55, 679.59

See application file for complete search history.

(56) References Cited

U.S. PATENT DOCUMENTS

| | | | | |
|---|---|---|---|---|
| 8,328,008 | B2 * | 12/2012 | Diebel | A45C 11/00 206/320 |
| 8,390,411 | B2 * | 3/2013 | Lauder | G06F 1/1656 206/320 |
| 8,434,601 | B2 * | 5/2013 | Hou | A45C 9/00 248/455 |
| 8,467,186 | B2 * | 6/2013 | Zeliff | G06F 1/1628 361/679.55 |

(Continued)

*Primary Examiner* — Bryon Gehman

(74) *Attorney, Agent, or Firm* — Patent Law Works LLP

(57) ABSTRACT

Technology associated with covering, protecting, and positioning portable electronic devices is described. In an example embodiment, a protective cover device includes a flap that is magnetically fastenable to a surface located on a backside of a portable electronic device. The protective cover device also includes a display protector attached to the flap and being positionable in a protective position to substantially cover a display of the portable electronic device. The display protector is articulatable to a position underneath a first side of the portable electronic device in which the flap and the display protector cooperatively prop up the portable electronic device in a landscape viewing position.

18 Claims, 21 Drawing Sheets

(56) References Cited

U.S. PATENT DOCUMENTS

| | | | | |
|---|---|---|---|---|
| 8,714,510 | B2 * | 5/2014 | McCosh | G06F 1/1626<br>206/45.23 |
| 8,780,535 | B2 * | 7/2014 | Mongan | A45C 11/00<br>361/679.01 |
| 8,878,637 | B2 * | 11/2014 | Sartee | G06F 1/16<br>206/320 |
| 8,887,903 | B2 * | 11/2014 | Diebel | G06F 1/16<br>206/45.24 |
| 2004/0159762 | A1 * | 8/2004 | Ghosh | G06F 1/16<br>248/351 |
| 2014/0036438 | A1 * | 2/2014 | Gioscia | G06F 1/1628<br>361/679.55 |

* cited by examiner

COVERING, PROTECTING, AND POSITIONING A PORTABLE ELECTRONIC DEVICE

CROSS-REFERENCE TO RELATED APPLICATIONS

The present application is a continuation of U.S. application Ser. No. 14/098,387, entitled "Device Covering, Protecting, and Positioning a Portable Electronic Device," filed Dec. 5, 2013, which claims the benefit under 35 U.S.C. §119(e) of U.S. Provisional Application No. 61/733,856, filed on Dec. 5, 2012, titled "Device for Covering, Protecting, and Positioning a Portable Electronic Device" and U.S. Provisional Application No. 61/768,996, filed on Feb. 25, 2013, titled "Device for Covering, Protecting, Charging, Enhancing and Positioning a Portable Electronic Device", the entire contents of each of which are incorporated herein by reference.

BACKGROUND

Technical Field

The present disclosure relates to covering, protecting, and positioning portable electronic devices. In particular, but without limitation, the present disclosure relates to apparatuses for protecting a portable electronic device including its exterior and screen, and positioning the screen of the device securely at multiple viewing angles.

Description of the Related Art

Hundreds of millions of portable electronic devices have been sold and are in use today. One of the largest complaints from owners of these devices is their susceptibility to damage to the intricate circuitry within and to the exterior of the device principally due to the device impacting a hard surface such as when the device is accidentally dropped.

Some existing solutions to this problem that have been proposed and developed include slight variations of a cover having a four-part construction: 1) a soft felt on the interior, 2) a rigid middle layer, 3) a durable exterior with aesthetic design elements, and 4) a flexible crease or spine that connects the cover to a side edge of the portable electronic device or a side edge of a rear component that protects the back of the portable electronic device. However, some of these solutions can make the portable electronic devices bulky and cumbersome to use. Others may be less cumbersome to use but fail to completely protect the devices from damage and wear. Further, some of these protective solutions may require several steps be performed to remove them from the devices they protect, thereby resulting in an inconvenient user experience.

Some existing solutions also provide users the ability to prop up their screens at various specific angles for more convenient viewing. However, these angles are generally preset and not customizable by the users, and thus restrict how users can situate their screens. Further, some existing solutions may incorporate magnets in their cover component to allow for automatically turning on and turn off the device when opened and closed, respectively.

SUMMARY

Technology for covering, protecting, and positioning portable electronic devices is described. In one innovative aspect, a protective cover device includes a display protector configured to substantially cover a display of a portable electronic device when articulated to a protective position.

The display protector is further configured to provide a contact surface to support the portable electronic device when articulated to a viewing position. The protective cover device further includes an articulating member connected to the display protector. The articulating member is configured to prop up the portable electronic device when the display protector is articulated to the viewing position. The articulating member including a magnetic fastener configured to magnetically detachably fasten to a compatible magnetic component locatable on a backside of the portable electronic device.

Other embodiments of one or more of these aspects include corresponding systems, devices, and methods.

The protective cover device and various other embodiments may each optionally include one or more of the following features including, but not limited to, a locking portion connected to the articulating member and the display protector; that the locking portion configured to magnetically secure the display protector in the viewing position; that the locking portion includes one or more magnetic components that magnetically fasten to one or more compatible magnetic components included in the display protector to engage the locking portion; a first joint connecting the display protector to the articulating member; that the first joint includes the locking portion; that the articulating member includes a second joint situated substantially parallel to the first joint and between the first joint and the magnetic fastener; that the articulation member includes an arm portion configured to pivot about the first joint relative to the display protector and a tilt portion configured to pivot about the second joint relative to the arm portion; that the tilt portion includes the magnetic fastener; that first joint, the arm portion, and the tilt portion are configured to cooperatively articulate the display of the portable electronic device from the protective position in which the display protector is configured to substantially cover the display to a viewing position in which the display protector is configured to support a bottom edge of the portable electronic device; that the arm portion and the tilt portion are configured to support and angle a back side of the portable electronic device, and the locking portion of the first joint is configured to lock the display protector into the viewing position; a back cover component configured to substantially cover the backside of the portable electronic device; that the back cover component includes the compatible magnetic component to which the magnetic fastener of the articulating member is configured to magnetically detachably fasten; that the back cover component includes a surface configured to substantially cover the backside of the portable electronic device; that the surface includes the compatible magnetic component in a central region that corresponds to a central region of the portable electronic device; that the compatible magnetic component is one of cross-shaped, circular, and polygonal; that the display protector includes one or more magnetic strips extending from a distal end of the display protector to a proximal end of the display protector that is connected to the articulating member; that the back cover includes one or more magnetic fasteners situated along a peripheral edge of the back cover in a manner that allows the one or more fasteners to detachably magnetically fasten to the one or more magnetic strips included in the display protector when the display protector is articulated to the viewing position to support the peripheral edge; that, when in the viewing position, the protective cover device is capable of being further situated in a privacy position by rotating the protective cover device counter clockwise substantially 90° as measured between a horizontal reference surface and the display protector and turning the protective cover device substantially 180° about an axis perpendicular to the horizontal reference surface; that the contact surface comprises a non-scratching microfiber material suitable for protecting the display of the portable electronic device; that the microfiber material has a texturized surface configured to facilitate micro-adjustments to a viewing angle of the display of the portable electronic device when propped up by the articulating member and supported by the contact surface of the display protector; and that the textured surface of the microfiber material includes one or more of a ribbed surface texture and a tacky surface texture.

In general, another innovative aspect of the subject matter described in this disclosure may be embodied in a method for making a protective cover device that includes a display protector configured to substantially cover a display of a portable electronic device when articulated to a protective position. The display protector is further configured to provide a contact surface to support the portable electronic device when articulated to a viewing position. The protective cover device further comprises an articulating member connected to the display protector. The articulating member is configured to prop up the portable electronic device when the display protector is articulated to the viewing position. The articulating member includes a magnetic fastener configured to magnetically detachably fasten to a compatible magnetic component locatable on a backside of the portable electronic device. The protective cover device further comprises a back cover component configured to substantially cover the backside of the portable electronic device. The back cover component includes the compatible magnetic component to which the magnetic fastener of the articulating member is configured to magnetically detachably fasten.

In general, another innovative aspect of the subject matter described in this disclosure may be embodied in a protective cover device including a flap that is magnetically fastenable to a surface located on a backside of a portable electronic device; and a display protector attached to the flap and being positionable in a protective position to substantially cover a display of the portable electronic device. The display protector is articulatable to a position underneath a first side of the portable electronic device in which the flap and the display protector cooperatively prop up the portable electronic device in a landscape viewing position.

The protective cover device and various other embodiments may each optionally include one or more of the following features including, but not limited to, that the display protector is rotatable via the flap from the first side of the portable electronic device to a second side of the portable electronic device that is substantially perpendicular to the first side so the display protector and flap cooperatively prop up the portable electronic device in a portrait viewing position; that the display protector is articulatable via the flap from the protective position to a position abutting and tangential to an uppermost side of the portable electronic device so the display protector and flap cooperatively prop up the portable electronic device in a privacy viewing position; that the flap magnetically detachably fastens to a central region of the surface; a back cover attachable to a backside of the portable electronic device; that the back cover includes the surface; that the surface includes one or more first magnetic components; that the flap includes one or more second magnetic components; that the flap is detachably magnetically fastenable to the back cover via the first magnetic components and second magnetic components; that the display protector includes one or more magnetic fastening components extending along at least a portion of a contact surface configured to support a peripheral edge of the back cover; that the back cover includes one or more magnetic fastening components situated along the peripheral edge of the back cover in a manner that allows the one or more magnetic fastening components included in the back cover to magnetically detachably fasten to the one or more fastening components included in the display protector; that the surface forms the backside of the portable electronic device; that the surface includes one or more first magnetic components; that the flap includes one or more second magnetic components; and that the flap detachably magnetically fastens to the portable electronic device via the first magnetic components and second magnetic components.

In general, yet another innovative aspect of the subject matter described in this disclosure may be embodied in a protective cover device including a back cover for a portable electronic device. The back cover includes a recessed cavity and a cross-shaped magnetic fastening component. The recessed cavity is configured to accept and retain the backside of the portable electronic device. The magnetic fastening component is included in that backside surface of the back cover and configured to magnetically detachably couple with one or more accessories for the portable electronic device.

The protective cover device and various other embodiments may each optionally include one or more of the following features including, but not limited to, an articulating display cover component configured to magnetically detachably couple with the back cover via the cross-shaped magnetic fastening component; and that the one or more accessories include an articulating display cover component, a keyboard, a stylus, a wall mount, and a desktop mount.

In general, yet another innovative aspect of the subject matter described in this disclosure may be embodied in a protective cover device including a display protector configured to substantially cover a display of a portable electronic device when articulated to a protective position. The display protector is further configured to provide a contact surface to support the portable electronic device when articulated to a viewing position. The protective cover device further includes an articulating member connected to the display protector. The articulating member configured to prop up the portable electronic device when the display protector is articulated to the viewing position. The articulating member includes a fastener configured to detachably fasten to a compatible fastening component locatable on a backside of the portable electronic device.

The protective cover device and various other embodiments may each optionally include one or more of the following features including, but not limited to, that the fastener and the compatible fastening component include one of a magnetic fastening component, a nano-suction adhesive, a nano-suction adhesive-compatible surface, a male connector, and a female connector.

It should be understood that the language used in the present disclosure has been principally selected for readability and instructional purposes, and not to limit the scope of the subject matter disclosed herein.

BRIEF DESCRIPTION OF THE DRAWINGS

The present disclosure is illustrated by way of example and not by way of limitation in the figures of the accompanying drawings in which like reference numerals are used to refer to similar elements.

FIG. 4A is a perspective view of an example back cover having an articulating display cover component being detachably fastened in.

DETAILED DESCRIPTION

Figure 1A:
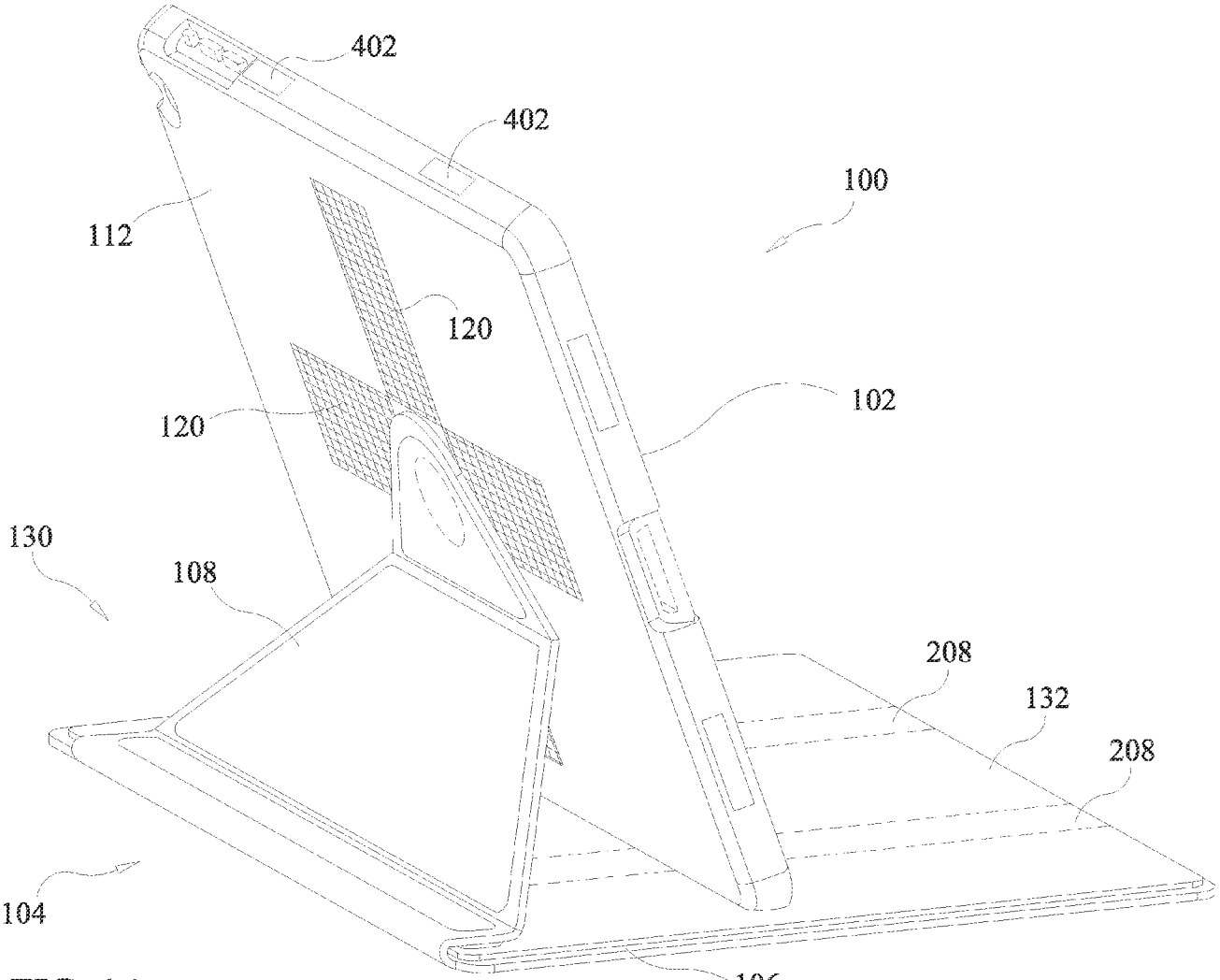
FIG. 1A is a perspective view of an example portable electronic device equipped with an example protective cover device situated in a landscape viewing position.

The present disclosure describes devices, systems, methods, and accessories for covering and protecting portable electronic devices and improving the ergonomics and useability of such devices. For example, a protective cover device is described that includes numerous unique and useful features for situating and using a portable electronic device, such as allowing the user to situate the screen of the device using a nearly unlimited number viewing angles ranging from approximately vertical to horizontal in both landscape and portrait positions, stably propping up the device on even or uneven surfaces, providing privacy to the user by shielding the screen from onlookers, having an easily removable display cover component that makes the electronic device convenient and easy to handle particularly during hand-held use, amplifying the speaker output of the device, etc., as depicted in the referenced figures and described in further detail below. Examples of portable electronic devices may include tablet computers, smartphones, or any other portable computing device with an integrated touch-screen display. Further examples may include, but are not limited to, Apple's iPad®, iPad Air™, iPad Mini™, iPhone®, etc., Samsung's Galaxy devices, etc., Amazon's Kindle™ devices, etc., etc.

As discussed in further detail herein, an example embodiment of a protective cover device may include a flap that is fastenable (e.g., magnetically) to a surface located on a backside of a portable electronic device. The surface may cover the backside of the portable electronic device, may form a portion of the portable electronic device, etc. The protective cover device may further include a display protector attached to the flap that is articulatable between various different positions. For example, the display protector is positionable via the flap in a protective position to substantially cover a display of the portable electronic device and can be articulated to a position (referred to herein in some cases as a viewing position) underneath whatever side of the portable electronic device is facing downward. In the viewing position, the flap and the display protector cooperatively prop up the portable electronic device at a desired viewing angle in a portrait, landscape, etc., orientation.

In some implementations, the protective cover device may include a separate back cover that is attachable to a backside of the portable electronic device, which includes the surface to which the flap detachably fastens. For instance, the surface may include one or more first magnetic components, the flap may include one or more second magnetic components, and the flap detachably may magnetically fasten to the back cover via the first magnetic components and second magnetic components. In some other implementations, instead of having a back cover, the surface may form at least a portion of the backside of the portable electronic device. As with the back cover, the surface may include one or more first magnetic components, the flap may include one or more second magnetic components, and the flap may detachably magnetically fastens to the portable electronic device via the first magnetic components and second magnetic components. Other variations are also possible.

One advantage of attaching the flap magnetically to the corresponding surface, which is also compatibly magnetic, is that the flap can be rotated around relative to the surface without coming detached and/or can be slid around within the magnetic area of the surface without coming detached. This allows the portable electronic device to be easily situated between a portrait and landscape orientation, and further allows a portable electronic device to be placed in numerous different convenient, stable positions for easy viewing and interaction by the user, as discussed elsewhere herein, on a nearly limitless number of surfaces, thus eliminating the frustration that can ensue when a traditional work surface (e.g., desk, table) is not available (e.g., on the subway) or desired (e.g., the user wants to lay down).

The flap and associated display protector are also easily removable from the back cover and/or the portable electronic device, as the case may be. The magnetic attachment between the flap and the surface is configured to have a predetermined level of magnetic attraction (bond strength)

that prevents the display protector/flap from just falling off due to their own collective weight but still allows for the flap and associated display protector to be easily removed from the back cover and/or the portable electronic device, as the case may be, by simply pulling the display protector and the back cover/portable electronic device apart with ones hands. Examples of magnetic components include rare-earth magnets (e.g., neodymium magnets, samarium-cobalt magnets), ferromagnetic metals, etc., although any magnetic fastening components capable of magnetically fastening together are contemplated and encompassed by the present disclosure.

While the various embodiments and implementations provided herein are described as using magnetic components to detachably (e.g., removably, articulatably, slideably, etc.) fasten various elements together, it should be understood that other suitable fastening components that have effectively the same or similar fastening attributes (e.g., such as nano-suction fastening components/tapes/surfaces, hook and loop, snaps or other friction-based male/female fasteners, etc.) may be used in conjunction with or in the place of the magnetic fasteners.

Figure 4A:
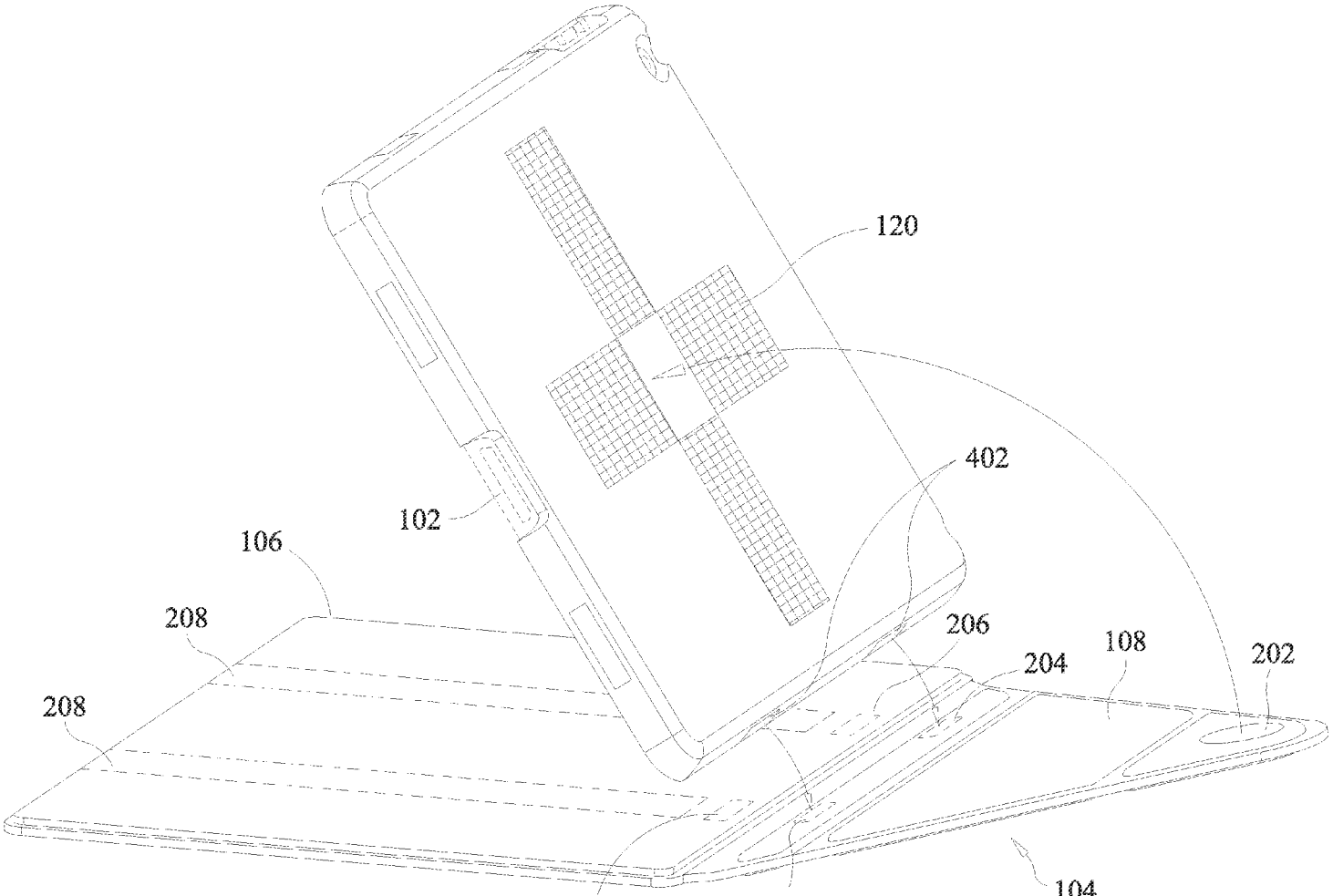
Figure 4B:
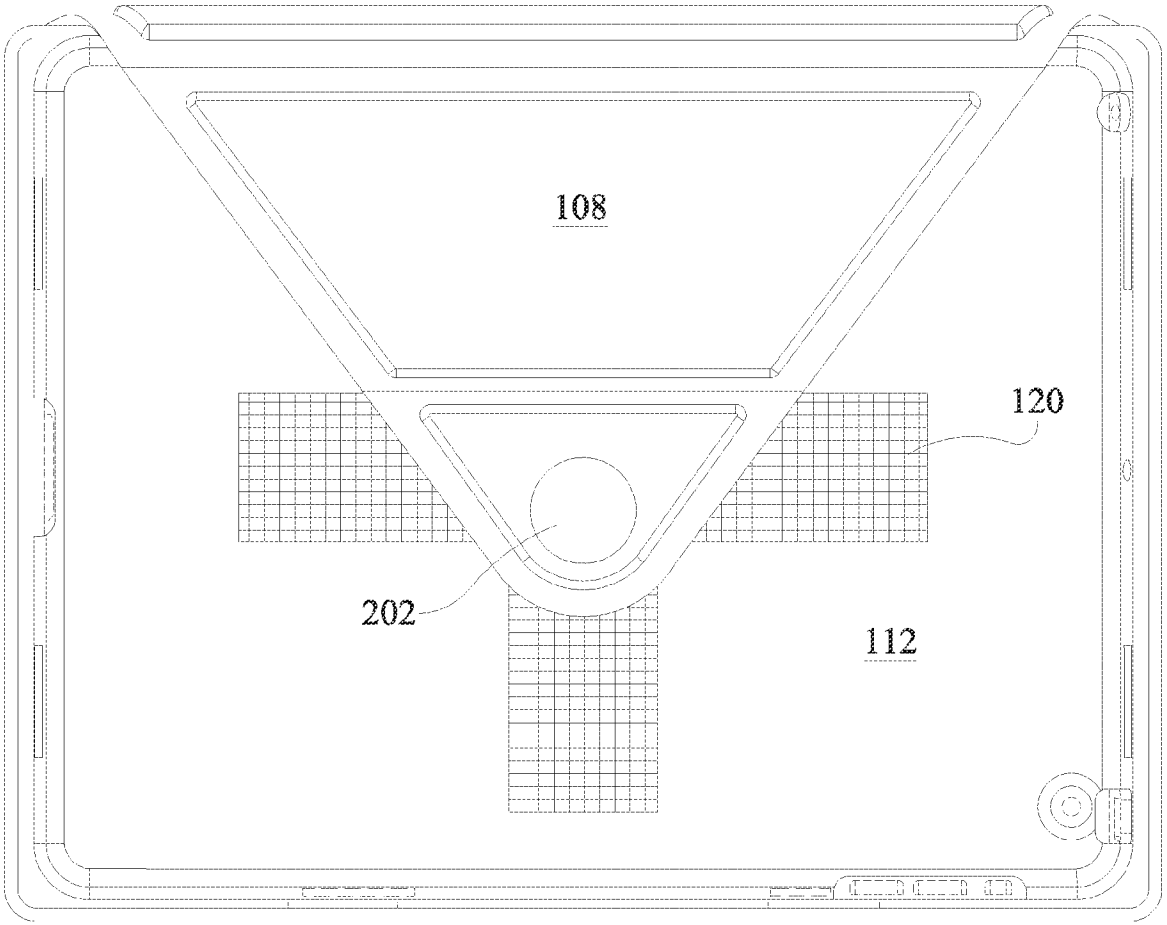
FIGS. 4B and 4C are bottom and top views of an example protective cover device positioned in a protective position.
Figure 4C:
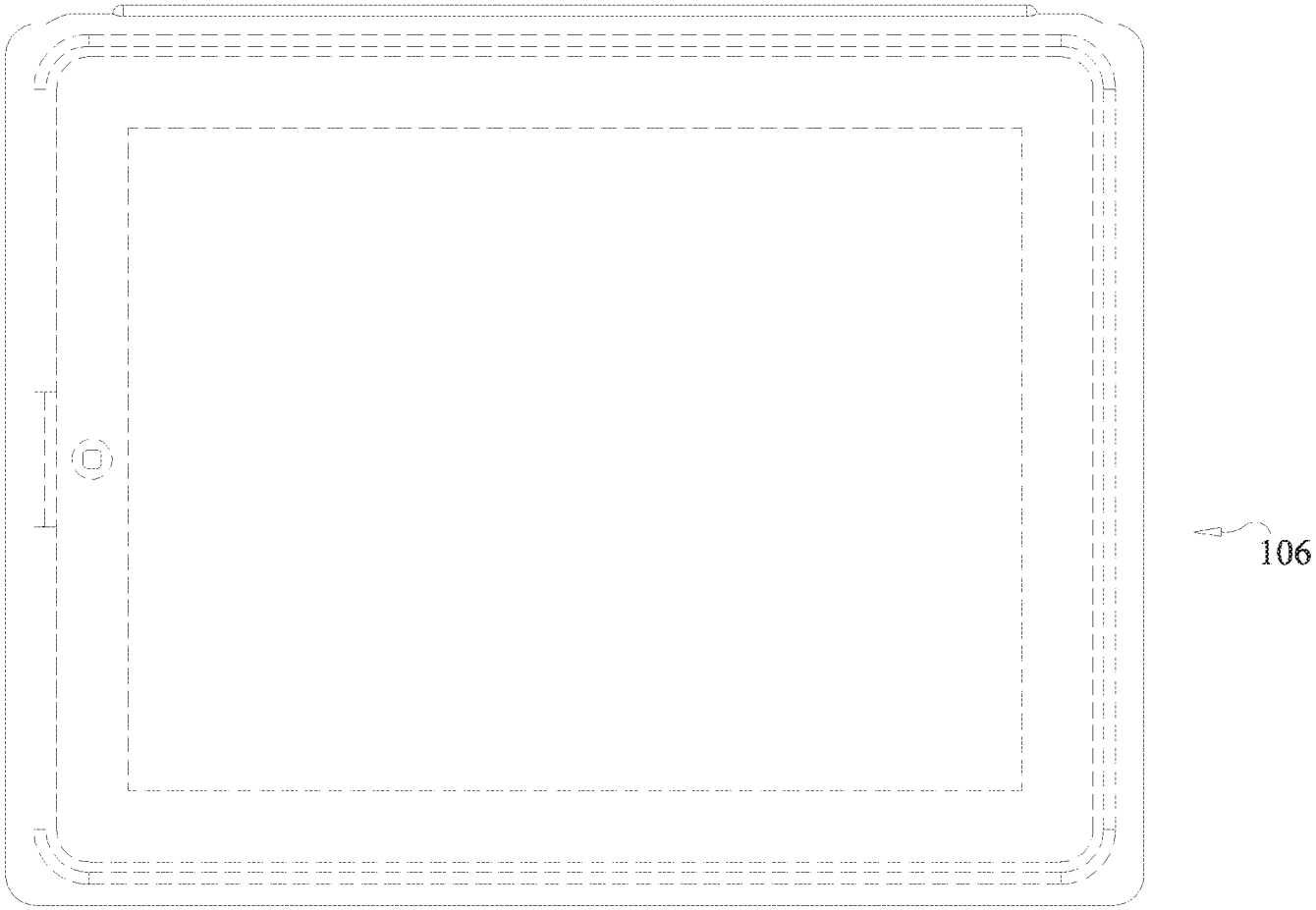
Figure 5:
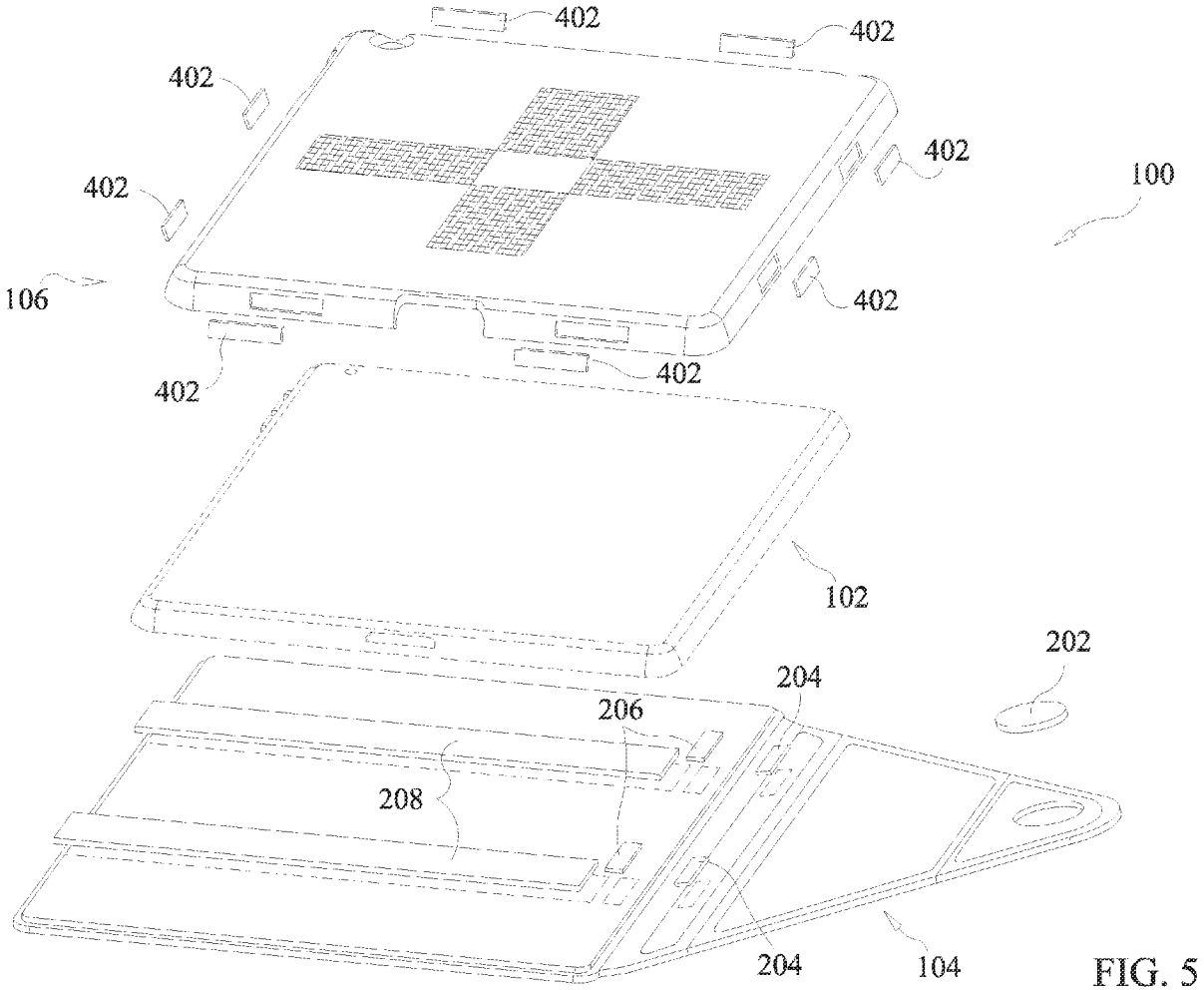
FIG. 5 is an exploded view of an example protective cover device.
Figure 9:
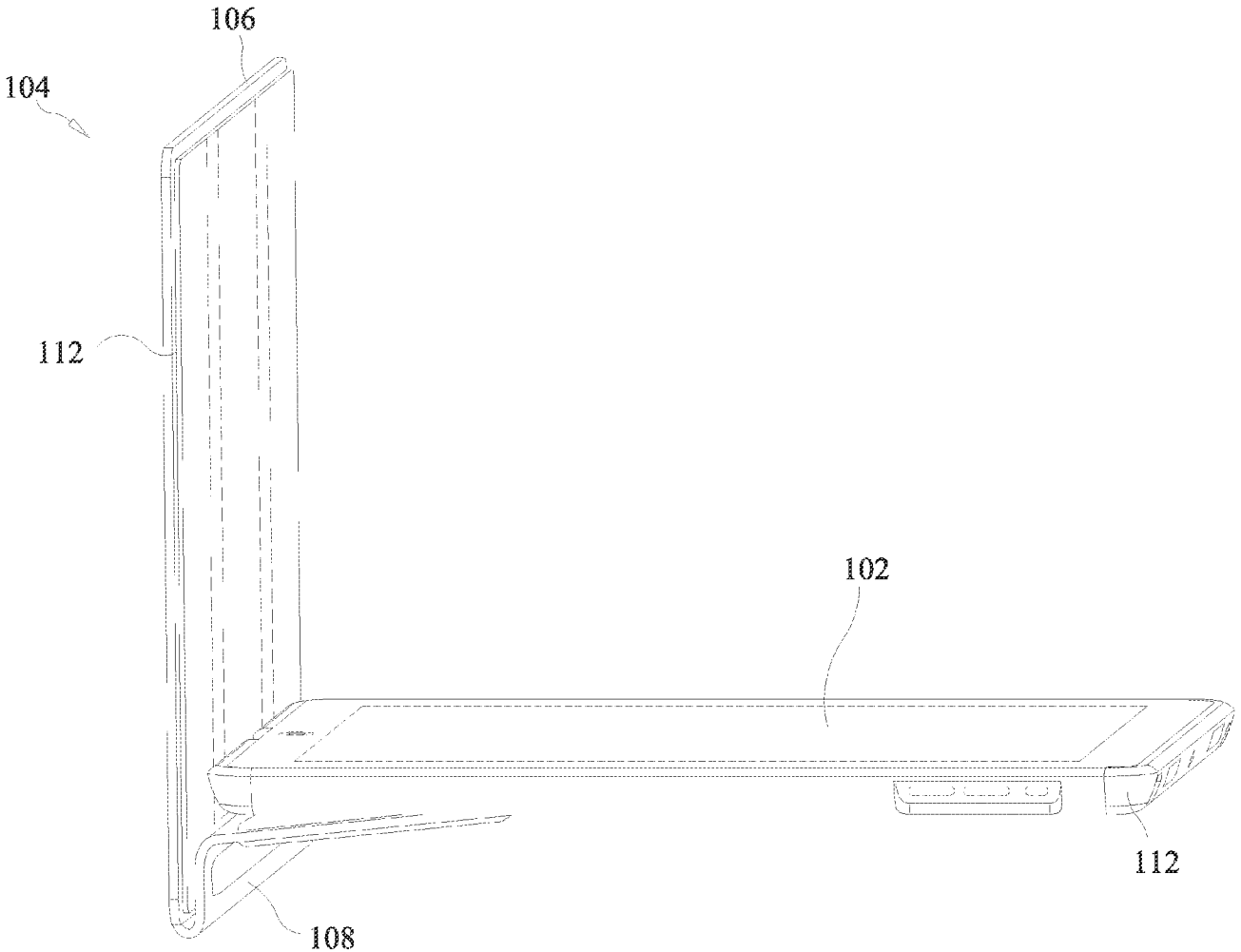
FIG. 9 is a perspective view of an example portable electronic device equipped with an example protective cover device situated in a privacy viewing position.

Various aspects of the protective cover device 100 are now described with collective reference to at least FIGS. 1A-1C, 2A, 2B, 3A, 3B, 4A-4C, and 5. FIG. 1A is a perspective view of an example portable electronic device 102 equipped with an example protective cover device 100 situated in a landscape viewing position. In the depicted embodiment, the protective cover device 100 includes an articulating display cover component 104 that is detachably fastenable to a back cover component 112. In some other embodiments, the articulating display cover component 104 may be detachably fastenable directly to a backside surface of a portable electronic device provided the portable electronic device includes one or more corresponding compatible fastening components. In these various embodiments, the articulating display cover component 104 may be releasable, rotatable, slideable, and attachable relative to the back cover component 112 and/or the electronic device 102 via a flap 130. The display cover component 104 includes a display protector 106 to substantially cover the display of the portable electronic device 102 when in a protective position, as shown in FIGS. 4A and 4B. The display protector 106 is further configured to provide a contact surface 132 for supporting, gripping, and/or helping to propping up the electronic device 102 when protective cover device 100 is opened into a viewing position, as depicted by at least FIGS. 1A and 1B, and to provide a privacy shield to shield the screen/display of the electronic device 102 when the protective cover device is closed into a privacy viewing position, as depicted by FIG. 9.

Figure 15:
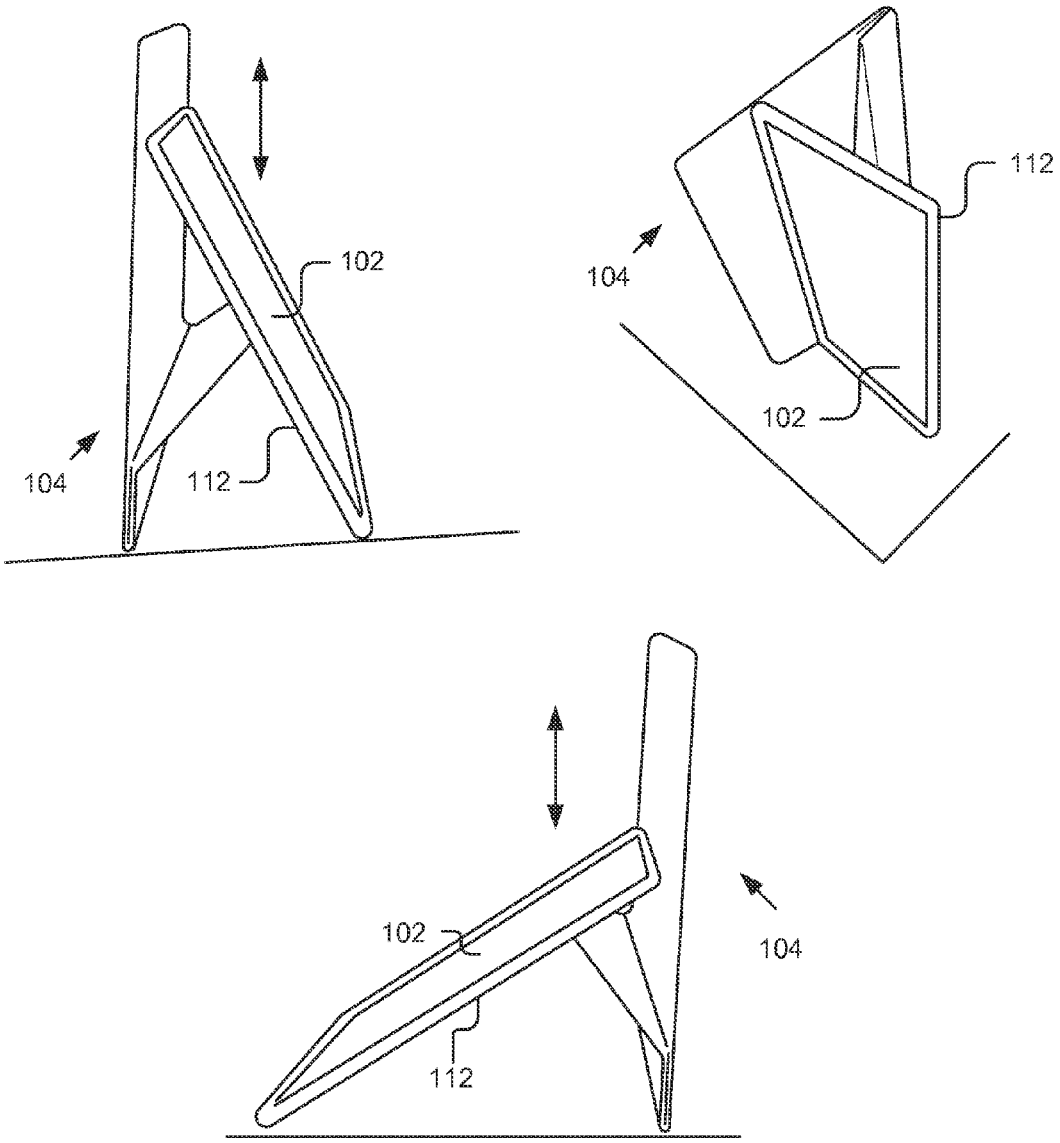
FIG. 15 illustrates various additional example configurations for an example protective cover device.

As depicted collectively in at least FIGS. 1A-1C, 2A, 2B, 4A-C, and 5, the flap 130 includes a joint 110 (referred to hereinafter for convenience as the "first" joint) and an articulating member 108. The display protector 106 is connected to the articulating member 108 via the joint 110. The first joint 110 allows the articulating member 108 to articulate the display protector 106 from the protective position (e.g., see FIGS. 4A and 4B) into regular (landscape, portrait, etc.) viewing positions (e.g., see FIGS. 1A-1C, and 8), privacy viewing positions (e.g., see FIG. 9), and various other orientations, such as, but not limited to those depicted in FIG. 15, which shows various additional example configurations for an example protective cover device 100 using reference numerals corresponding to those used in at least FIGS. 1A and 1B. It should be understood that providing a user the ability to securely orient his/her portable electronic device 102 in a variety of positions, allows the user to conveniently use his/her device 102 in ways that were previously unworkable or inconvenient (e.g., holding, as a book, the device 102 in one hand and the display protector 106 in the other; situating the device 102 in the privacy viewing position discussed herein to block onlooking eyes, rays of the sun; setting the device 102 on ones stomach or chest while in a reclined position for convenient viewing, etc.).

Figure 1C:
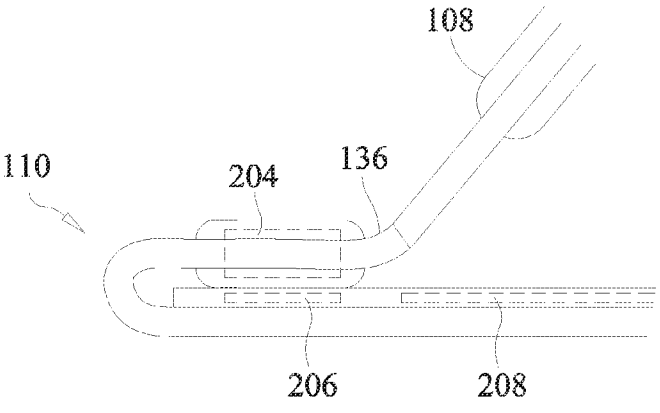
FIG. 1C is a side view of an example joint connecting an example articulating member and an example display protector.
Figure 1B:
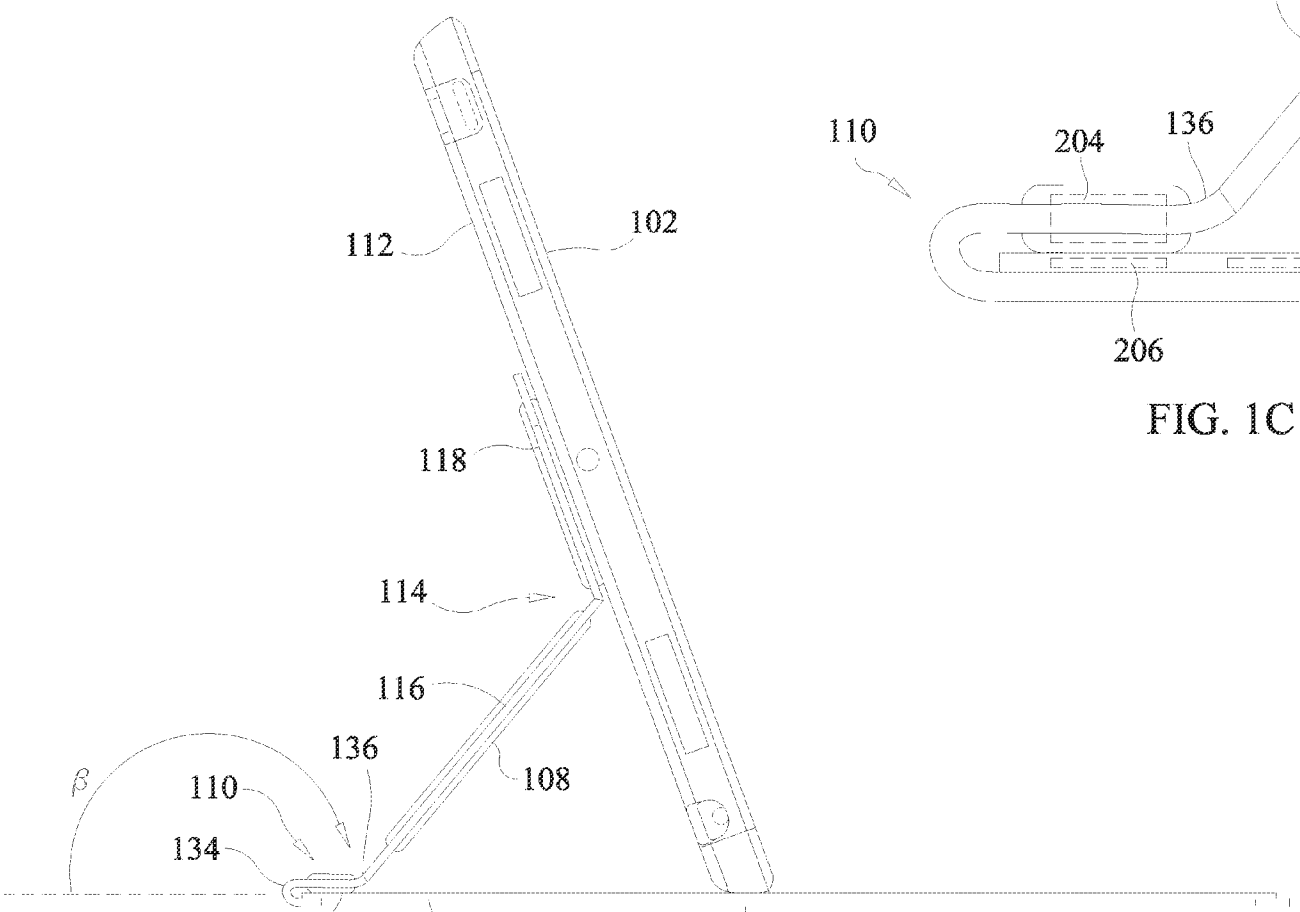
FIG. 1B is a side view of an example portable electronic device equipped with an example protective cover device situated in a landscape viewing position.

The first joint 110 may include a number of different configurations. In some embodiments, as depicted in FIGS. 1B and 1C, the first joint 110 may be configured to pivot the articulating member 108 into a desired position and lock it in that position, so as to stably support the back cover component 112/portable electronic device 102. For example, the first joint 110 may include a first and second pivot point (134 and 136, respectively) connected by an elongated locking portion 124 extending from a first side edge of the display cover component 104 to a second side edge of the display cover component 104. The second pivot point 136 pivotably attaches the locking portion 124 to the articulating member 108. To position the locking portion 124 into a locking position, the first pivot point 134 may pivot the locking portion 124 at angle β (e.g., clockwise approximately 180 degrees) back onto an inward-facing surface of the display portion. The angle of β is measured relative to a surface plane tangential to the contact surface 132 (see FIG. 1A) of the display protector 106.

The locking portion 124 may include a first set of one or more magnetic component(s) 204. In some embodiments, one or more magnetic strips or magnets 204 may be included in the locking portion 124. For instance, with reference to FIGS. 1C and 2A, the first joint 110 may include two or more magnetic components 204 configured to couple to corresponding magnetic components 206 adjacently situated in the display protector 106. The magnetic component(s) of the locking portion 124 may be made of a magnetic material. A region 122 of the display protector 106 that faces the locking portion 124 when the joint 110 is in a locking position may include a corresponding second set of magnetic component (s) 206 or may be made of a compatible magnetic material that is/are configured to detachably fasten to the magnetic component(s) 204 of the first set, thereby locking the locking portion 124 against the region 122 of the display protector 106.

In the depicted embodiment, the two or more magnetic components 204 in the locking portion 124 at spaced a predetermined distance apart to stably lock and hold the display protector 106 into the desired orientation. The corresponding magnetic components 206 are similarly space apart in the display protector 106 so when the joint 110 is folded over onto the corresponding surface (e.g., region 122) of the display protector 106, the magnetic components 204 magnetically engage with the corresponding magnetic components 206 to lock/hold the display cover component 104 into place. It should be understood, that other variations for the locking portion 124 are possible and encompassed by the present disclosure. For instance, the two or more magnetic components depicted in FIGS. 1C and 2A can be replaced with one continuous magnetic component, a magnetic coating applied to a surface of the joint 110 configured to face the region 122 of the display portion 106 when locked, etc.

In some embodiments, an end portion of the magnetic strips 208 may constitute the corresponding magnetic components 206. In other embodiments, separate magnetic components 206 may be included in the display protector 106 between the magnetic strips 208 and the joint 110. In these embodiments, the length of the magnetic strips 208 may be shorter than in the former embodiments to accommodate the additional magnetic components 206. The one or more magnetic strips may extend along the display protector 106 substantially parallel to the contact surface 132 from a distal end of the display protector 106 toward an end proximal to the joint 110. In some cases, the magnetic strip(s) may be embedded under, covered by, or inlayed into the contact surface 132, although other configurations are possible. In yet further embodiments, other techniques to magnetize the surface of the display protector 106, or various portions thereof, may be used, such as applying a magnetic coating to or underneath the contact surface 132 of the display portion 106.

In some embodiments, any or all of the magnetic components 204 and 206 may be inserted (e.g., hidden) on the inside of the locking portion 124 and the display protector 106 to preserve their aesthetic appearance and not abrade or scratch the surface of the back cover component 112 or electronic device 102. However, it should be understood that other configurations are possible, contemplated, and within the scope of this disclosure. Moreover, it should be understood that other types of fasteners (hook/loop, snaps, nano-suction adhesive, etc.) may be included in the place of or supplemental to the magnetic components to enable the locking of the locking portion 124. Further, in other embodiments, the magnets/fasteners may be omitted or unused and the locking portion 124 may lock by virtue of being folded over onto the display portion and being held in place by the weight of the back cover component 112/portable electronic device 102. The locking portion 124 is advantageous as it can securely maintain the portable electronic device 102 and/or back cover 112 in a desired orientation even if the assembly is bumped, moved around, etc.

In some embodiments, the locking force of the locking portion 124 when engaged with the display portion 106 is configured to exceed the counter force produced by the combined weight of the back cover component 112 and the portable electronic device 102 when placed in the various non-protective positions of the protective cover device 100. This allows the locking portion 124 to remain locked until the user decides to unlock it by detaching (e.g., pulling the locking portion 124 away) from the region 122 of the display portion 106 to which it is magnetically coupled. As the weight of different portable electronic devices 102 may vary, the locking force can be adapted to the specific device for a specific variant of the portable electronic device 102.

In some embodiments, the display cover component 104 may be formed as a continuous element, and the first joint 110 may be formed in this element to divide the display protector 106 and the articulating member 108 and allow them to articulate relative to one another via the joint, as depicted in FIGS. 1B and 1C. In other embodiments, the display protector 106 and the articulating member 108 may be distinct components and the first joint 110 may include one or more hinges or similar types of pivotable couplings capable of attaching the display protector 106 and the articulating member 108 such that they can pivot and lock relative to one another. While the foregoing examples are provided, it should be understood that many other joint configurations are possible and contemplated.

As depicted in FIG. 1B, the articulating member 108 of the display cover component 104 may include an arm portion 116 and a tilt portion 118 that are pivotably connected via a joint 114 (referred to herein as the second joint 114) and can cooperatively position the display of the portable electronic device 102 incrementally at any viewing angle ranging from 0° (horizontal) to substantially 110° (vertical), as measured between an upward-facing surface of the display cover component 104 and a rearward-facing surface of the display of the portable electronic device 102. In some embodiments, the second joint 114 is situated substantially parallel to the first joint 110. As with the first joint 110, the second joint 114 may include one or more folds, creases, perforations, hinges, and/or similar types of pivotable couplings capable of pivotably connecting the arm portion 116 and a tilt portion 118 to one another.

In some embodiments, the tilt portion 118 can pivot relative to the arm portion 116 via the second joint 114 to adjust the angle of the back cover component 112/portable electronic device 102 and the arm portion 116 can pivot relative to the display protector 106 via the first joint 110 to adjust where the bottom edge of the device 102 or back cover component 112 (as the case may be) contacts/rests on the display protector 106. As with the display protector 106 and the articulation portion 108, the arm portion 116 and the tilt portion 118 may be integrally formed with the articulating member 108 or may be discrete components connected together by the joint 114.

Figure 7:
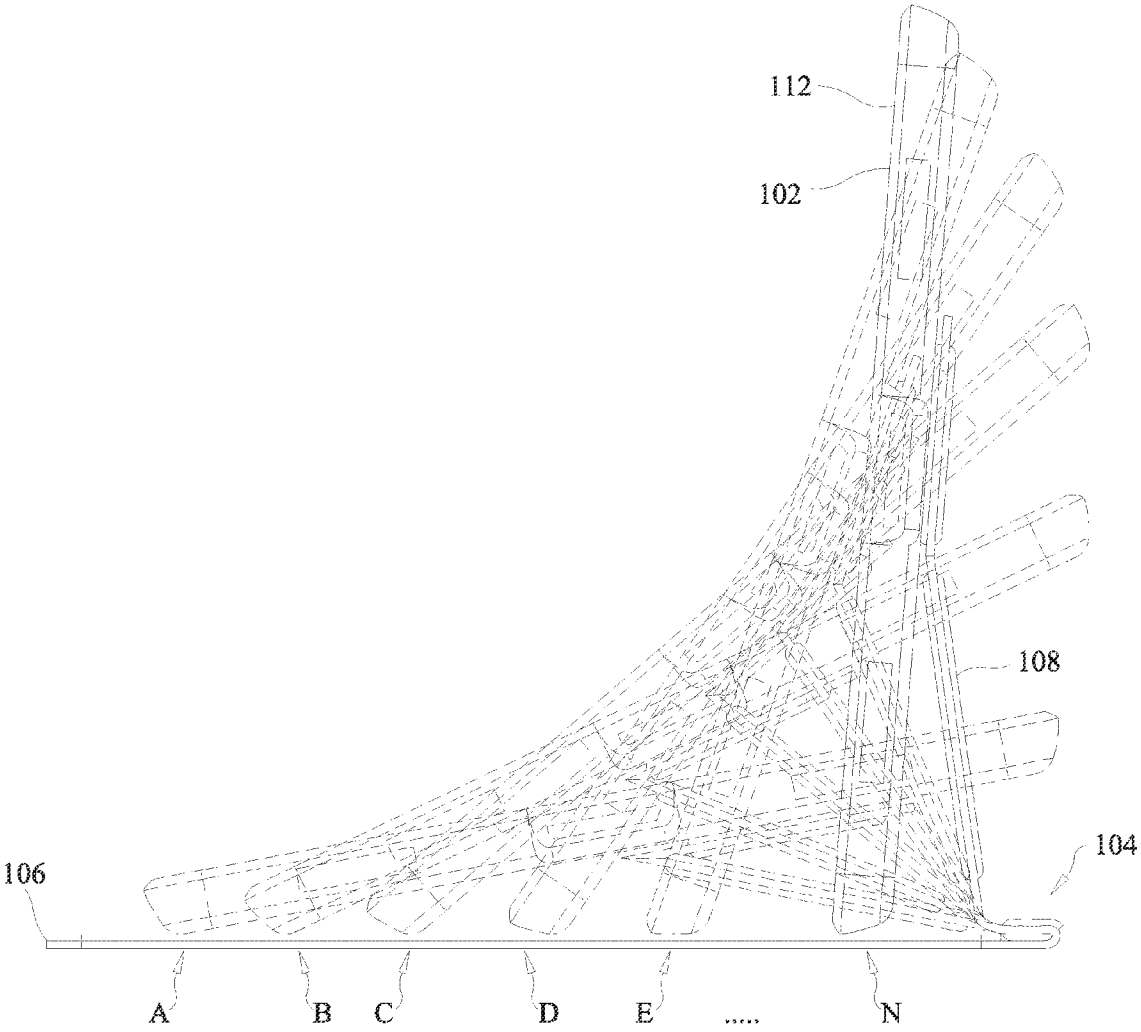
FIG. 7 is a side view of an example portable electronic device equipped with an example protective cover device situated in a number of different example viewing angles.

By way of further example, FIG. 7 shows a side view of an example portable electronic device 102 positioned by the protective cover device 100 in a number of different viewing angles relative to a horizontal plane, such as a table, floor, bed, hands, or any other suitable surface on which the device may rest. In particular, the protective cover device 100 is used as a stand to prop up the device 102 at various angles, such as at approximately 90°, approximately 45°, and approximately 10°. As depicted, a user may place the portable electronic device 102 in any number of positions A, B, C, D, E, . . . N by situating the back cover component 112 back or forward on the display protector 106. However, it should be understood that depicted positions, angles, etc., are provided by way of example, and that the device 102 may be propped up by the protective cover device 100 at virtually any viewing angle ranging from approximately 0° to approximately 110° to provide the user with an optimal viewing experience, as measured from a backside of the portable electronic device 102/back cover component 112 and the surface plane tangential to the display protector 106.

By way of further illustration, a portable electronic device 102 equipped with the protective cover device 100 can be adjusted in at least the following example two ways: 1) the user can slide the edge of the portable electronic device 102 back and forth along the contact surface 132 of the display cover component 104 to a desired position, in which the portable electronic device 102 is secured to that point of the contact surface 132 by at least the magnetic components (e.g., 402 and 208); and 2) the user can slide the flap 130 around on the surface of the magnetic component 120 located on the backside of the back cover component 112 and/or the portable electronic device 102 to situate the display cover component 104 to a desired position relative to the portable electronic device 102. The combination of at least these two methods for adjusting the protective cover device 100 is advantageous because it allows the user to situate the portable electronic device 102 in a nearly unlimited number of angles and configurations.

Again collectively referring to at least FIGS. 1A-1C, 2A, 2B, 4A-C, and 5, the articulating member 108 may extend from the first joint 110 along the backside of the electronic device 102 to a central region of the back cover component 112 that covers a backside of the portable electronic device 102. The articulating member 108 is removably attached via one or more fasteners 202 (e.g., see FIG. 2A) to the backside of the portable electronic device 102 in the central region.

In some embodiments, the fastener 202 fastens magnetically to a compatible fastening component 120 included in the back cover component 112 (e.g., see FIGS. 4A and 4B). For example, the articulating member 108 may include at least a first magnet 202, the back cover component 112 may include at least a second magnet 120, and the articulating member 108 may detachably couple to the back cover component 112 when the first and second magnets 202, 120 are situated adjacently within each other's magnetic fields. In another example, a fastener 202 included in the articulating member 108 may be a magnet and the back cover 112 may include a ferrous material 120 to which the magnet may be attracted and become detachably coupled with. In another example, the articulating member 108 may be made of ferromagnetic metal and/or may include a ferromagnetic material in the fastening region which may be configured to couple to one or more magnets included in the back cover component 112. However, it should be understood that numerous other ways for magnetically fastening the display cover component 104 and the back cover component 112 are contemplated and encompassed by the present disclosure. For instance, the back cover component 112 and the articulating member 108 may include any combination of magnets and ferromagnetic material to facilitate the coupling of the back cover component 112 and the articulating member 108. Furthermore, in some embodiments where the back cover 112 is not included, the magnetic fastening component 120 may be incorporated directly into the electronic device 102, and the display cover component 104 may fasten magnetically and directly to a backside surface of the electronic device 102.

In embodiments where the central region of the back cover 112 or the electronic device 102 is lined with magnetic material 120, the magnetic fastener of the display cover component 104 can be slid around within the central region while remaining securely fastened to the back cover component 112. For example, the back cover may include one or more magnetic strips. The magnetic strip(s) 120 may be elongated along the backside surface of the back cover 112 in such a way as to allow the user to adjust where the flap of the display cover fastens to the back cover 112. As a further example, as depicted in FIG. 1A, the back cover 112 may include a cross-shaped metallic component on the backside of the back cover 112 that allows the flap 130 to fasten to and/or fastenably slide along a nearly infinite number of points within the cross, as discussed in further detail herein with reference to at least FIG. 13.

Using magnetic material to attach the display cover component 104 to the back cover component 112 provides numerous benefits. For example, the display cover component 104 can fasten to the back cover component 112 anywhere within a magnetized region and is not necessarily required to fasten to the back cover 112 in a particular location. This provides the user with flexibility on where to situate the display cover component 104 relative to the back cover component 112, and by extension, the portable electronic device 102. This also provides the user the advantage of making macro and micro adjustments to the overall position of the display cover component 104 to better customize the placement and viewing angle of the portable electronic device 102, particularly when switching the orientation of the device from landscape to portrait.

Figure 8:
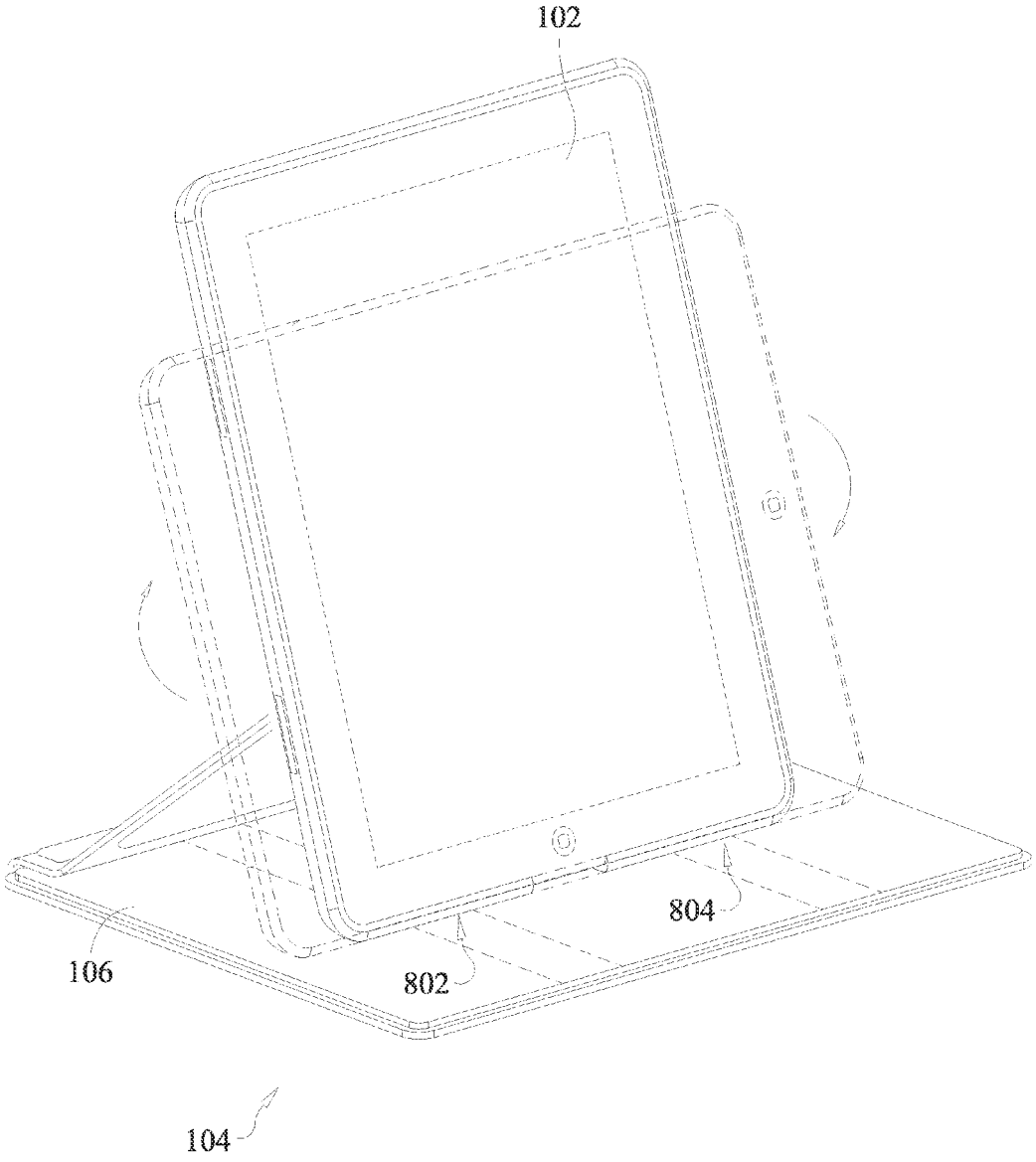
FIG. 8 is a perspective view of an example portable electronic device equipped with an example protective cover device that has been positioned into a portrait viewing position from a landscape viewing position.

For example, FIG. 8 is a perspective view of an example portable electronic device 102 equipped with an example protective cover device 100 that has been positioned into a portrait viewing position from a landscape viewing position. In this example, the portable electronic device 102 can be snapped into position and/or slideably adjusted to a desired angle on the display protector 106 of the display cover component 104 via magnetic components included in the side-edge of the back cover 112 which are configured to couple at points 802 and 804 to the magnetic strips 208 included in the display portion 106, as discussed elsewhere herein.

Further, since the magnetic fastener(s) (e.g., 202) in the display cover component 104 are not rigidly secured, they can rotate relative to one another without becoming detached. This conveniently allows the display cover component 104 to rotate from a landscape orientation to a portrait orientation without being separated from the back cover component 112 as depicted in FIG. 8. In addition, the use of magnetic fasteners advantageously allows the display cover component 104 to be easily removed from the back cover component 112 by the user simply pulling the two components apart, which can provide for more convenient hand-held use of the portable electronic device 102 when it is not in a propped up/viewing position.

Figure 2A:
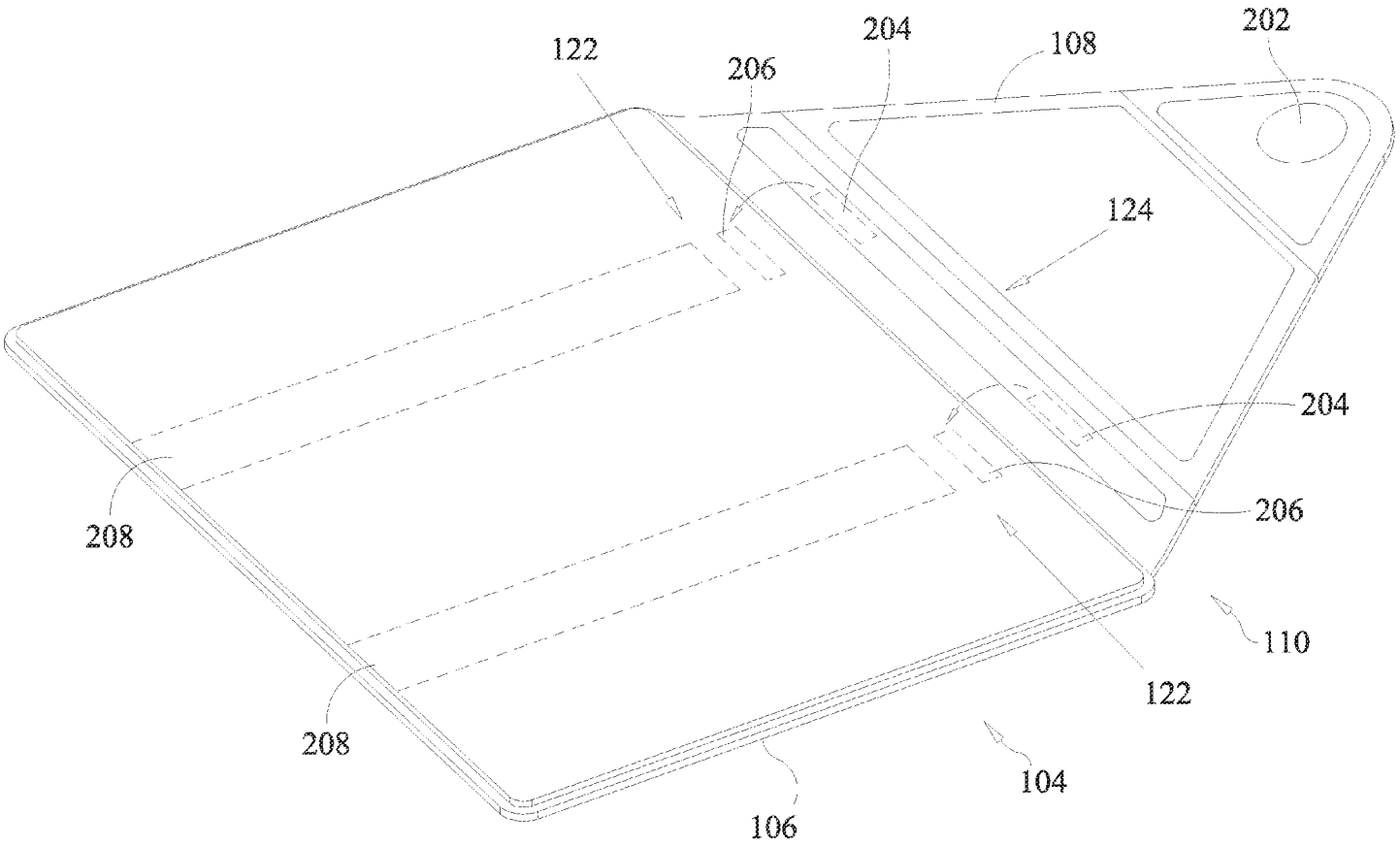
FIGS. 2A and 2B are perspective views of an example articulating display cover component.
Figure 2B:
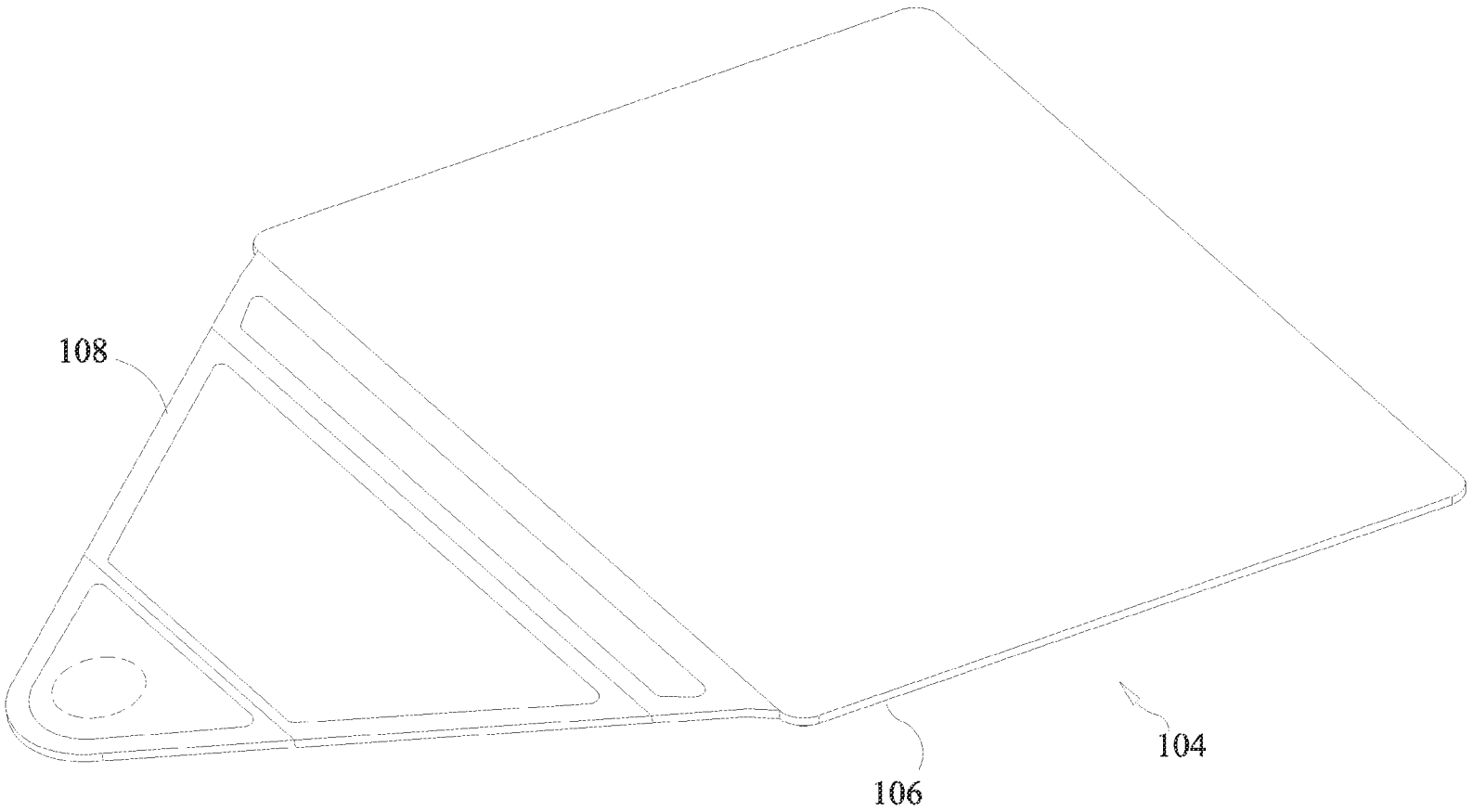
Figure 3A:
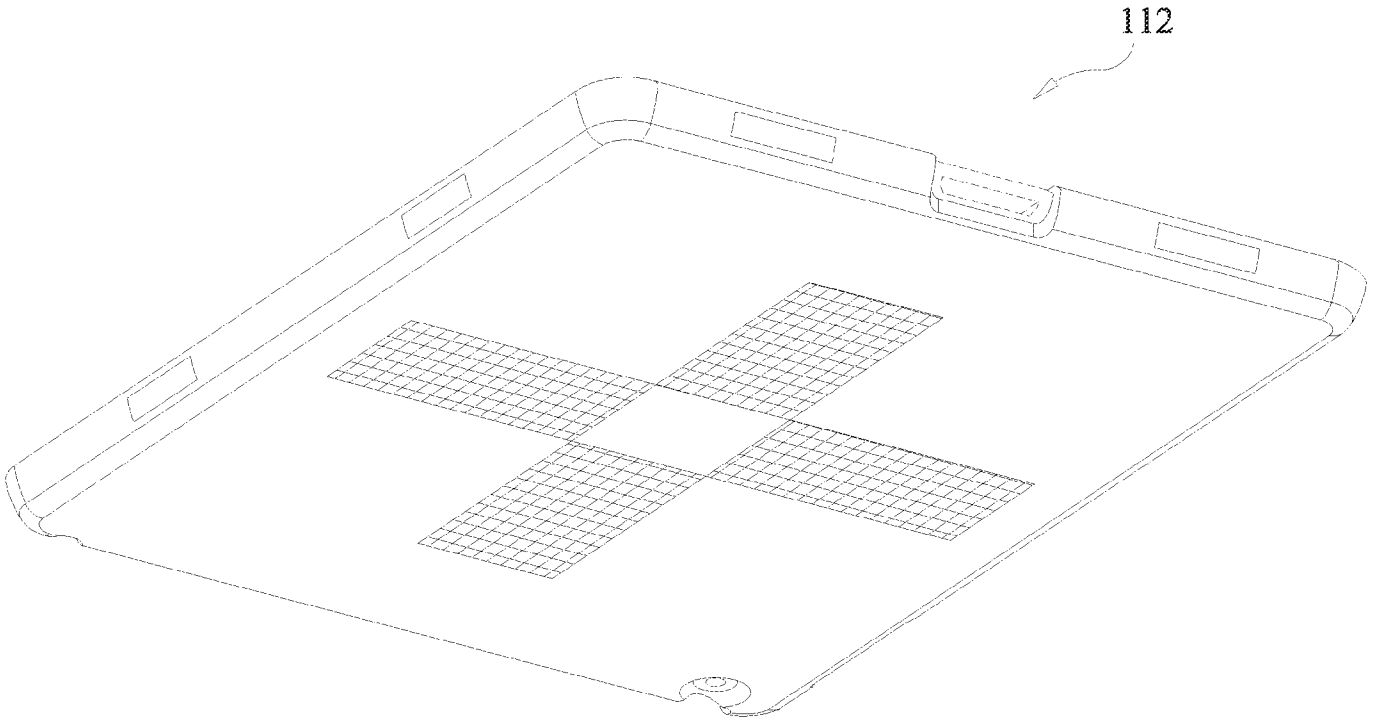
FIGS. 3A and 3B are bottom and top perspective views of a portable electronic device equipped with an example back cover component.
Figure 3B:
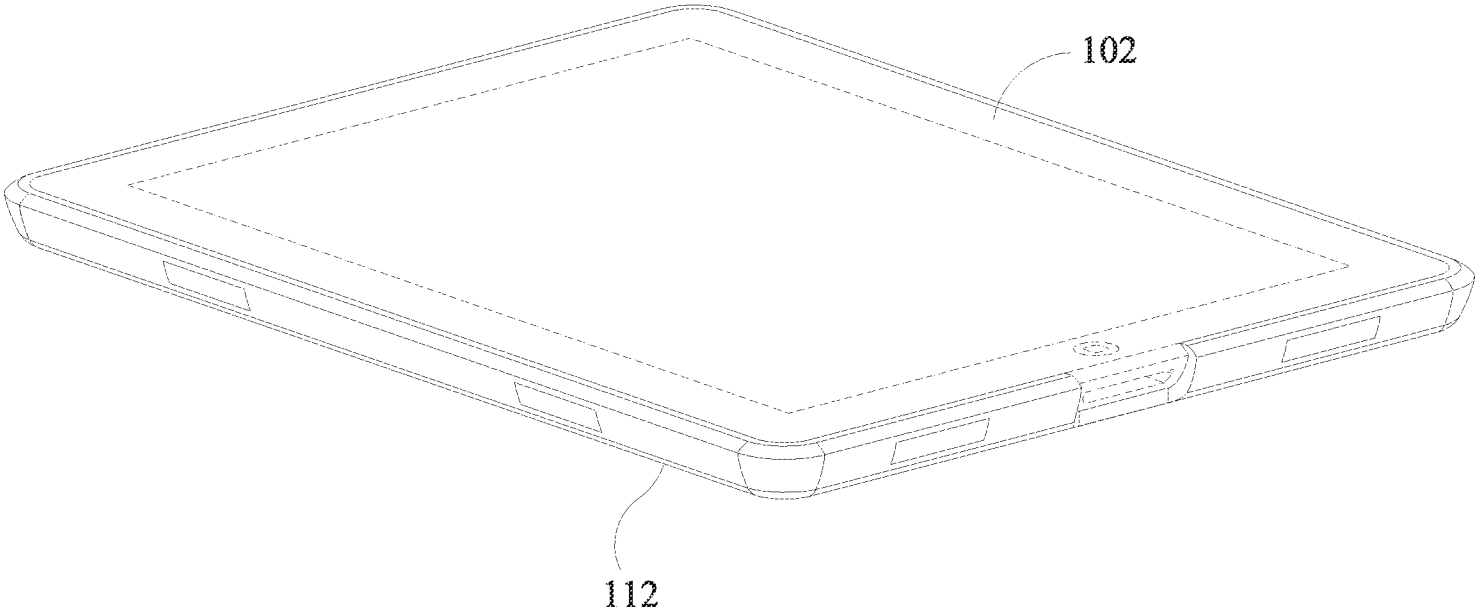

In some embodiments, the back cover component 112 may include one or more magnetic fasteners that are situated along one or more peripheral edges and configured to fasten magnetically to the one or more magnetic fasteners of the locking portion 124 (e.g., see 204 of FIG. 2A). For example, as depicted in FIG. 4A, the display cover component 104 may include two or more magnetic fasteners 204 that are configured to magnetically fasten to two or more corresponding magnetic fasteners 402 in back cover component 112.

It should be understood that numerous other configurations are possible, such as, but not limited to, including continuous magnetic strips in one or more of the peripheral edges/side-walls of the back cover component 112. Further, it should be understood that any suitable ratio of fasteners included in the back cover 112 to those include in the display cover component 104 may be used to provide benefit described herein (e.g., 1:1, 2:2, 3:3, 4:2, 2:4, 1 magnetic strip to 4 magnets, 4 magnets to 1 magnetic strip, etc.). As an additional example, the magnetic component(s) 204 in the joint 110 of the display cover component 104 may be configured to match up to corresponding magnetic component(s) 402 in the back cover 112 using any suitable ratio. This is advantageous because, in addition to the magnetic coupling between the flap 130 and the magnetic component 120 on the backside of the device 102/back cover 112, these fasteners (e.g., 204, 402) can further couple the display cover component 104 to the back cover 112/device 102 along the joint 110 when situated in the protective position (e.g., see FIG. 4A).

In other examples, the locking portion 124 may be made of a ferromagnetic material that is configured to magnetically fasten to one or more magnets included in the locking portion 124, as discussed elsewhere herein. In yet other examples, the entire flap region 130, or suitable portions thereof, may be made of or include ferromagnetic material configured to magnetically fasten to the magnetic components (e.g., 402, 120) included in the back cover 112. Numerous other configurations are also possible and contemplated, as discussed above with reference to components 202 and 120.

In some embodiments, the one or more fasteners respectively included in the articulating member 108 and the back cover component 112 may include other types of fasteners and may have other configurations. For example, the fastener included in the articulating member 108 may include an angled hook, snap, hook-or-loop, bolt, nut, screw, another threaded component, etc., and the back cover component 112 may include a corresponding compatible fastening component for securing the fastener.

While the embodiments depicted in at least FIGS. 1A-1C, 2A, 2B, 4A-C, and 5 illustrate the display cover component 104 as being fastenable to the back cover component 112, it should be understood that in other embodiments, the back cover component 112 could be eliminated and the display cover component 104 could instead be fastened directly to the portable electronic device 102, as discussed elsewhere herein. For example, the fastening component(s) 120 included in the in back cover 112 may be incorporated into a central region backside region of the portable electronic device 102 itself and the fastener(s) 202 included in the articulating member 108 may fasten directly to it.

Figure 6B:
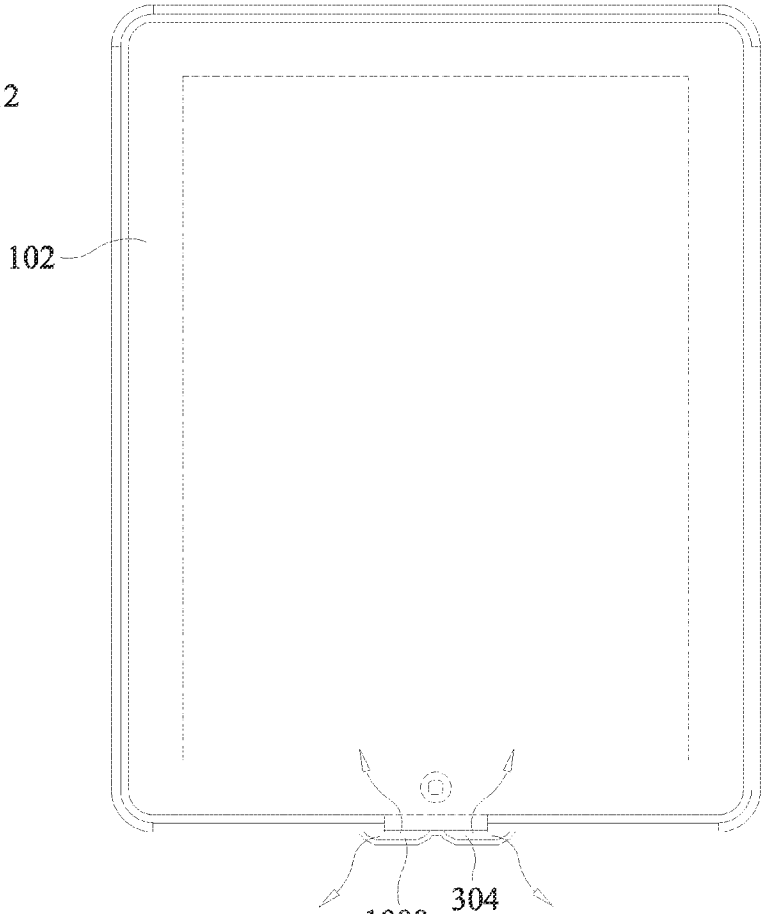
FIGS. 6A and 6B are bottom and top views of an example portable electronic device equipped with an example back cover component having a hideable speaker amplification component.
Figure 6A:
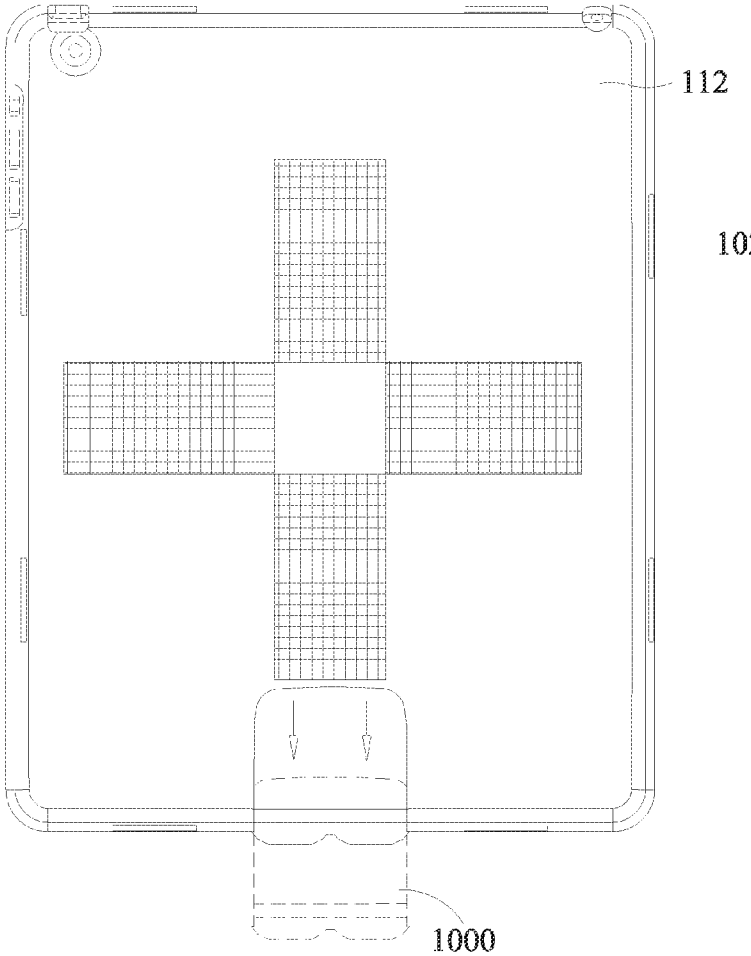

FIGS. 6A and 6B includes bottom and top perspective views of an example portable electronic device 102 equipped with an example back cover component 112 having a hideable speaker amplification component 1000. In some embodiments, the back cover component 112 may serve as a protective shell and the hideable component 1000 may form part of that shell when in a closed position and is configured to slide outwardly relative to the remaining/stationary portion of the shell when in an open position. In an open position as illustrated in FIG. 6A, the hideable component 1000 protrudes outwardly from an edge (e.g., side, bottom, etc.) of the example portable electronic device 102 and on the underside of one or more speakers 304 that are included in the portable electronic device along that edge.

The edges of the back cover 112, and correspondingly the distal edge of the hideable amplification component 1000, are curved inward relative to the inside surface of the back cover 112 that faces a backside surface of the portable electronic device 102. The curvature is configured to follow the curvature of the backside surface of the portable electronic device 102 so the back cover 112 may closely align and snuggly fit/grip to the backside of the portable electronic device when affixed to it. When the hideable amplification component 1000 is in the open position, the curved distal edge advantageously redirects sound waves that are emitted downward by the speaker 304 in a forward direction toward a user of the portable electronic device 102. This is advantageous as it amplifies the sound being emitted by the speaker 304 so it is easier for the user to hear. Once use of the speaker 304 is complete, the hideable amplification component 1000 may be slideably retracted inward within the periphery of the back cover component 112 to a closed position as illustrated in FIG. 6B.

In some embodiments, the horizontal edges of the hideable amplification component 1000 depicted in FIGS. 6A and 6B may be grooved and corresponding groves may be included in edges of the slot that the hideable amplification component 1000 slides in and out of. The groves of the component 1000 and the slot may be compatible and configured to 1) retain and/or releasably lock the component 1000 when in the closed position, 2) allow the component 1000 to securely slide to the open position, and 3) stop/secure the component 1000 when it is in its fully extended/open position (e.g., so the component 1000 does not fall out).

FIG. 9 is a perspective view of an example portable electronic device 102 equipped with an example display cover component 104 situated in a privacy viewing position. As discussed elsewhere herein, the display protector 106 is coupled to the back cover 112 via the articulating member 108 and one or more magnetic fasteners (hidden from view) included in the bottom side of the back cover 112.

Figure 10:
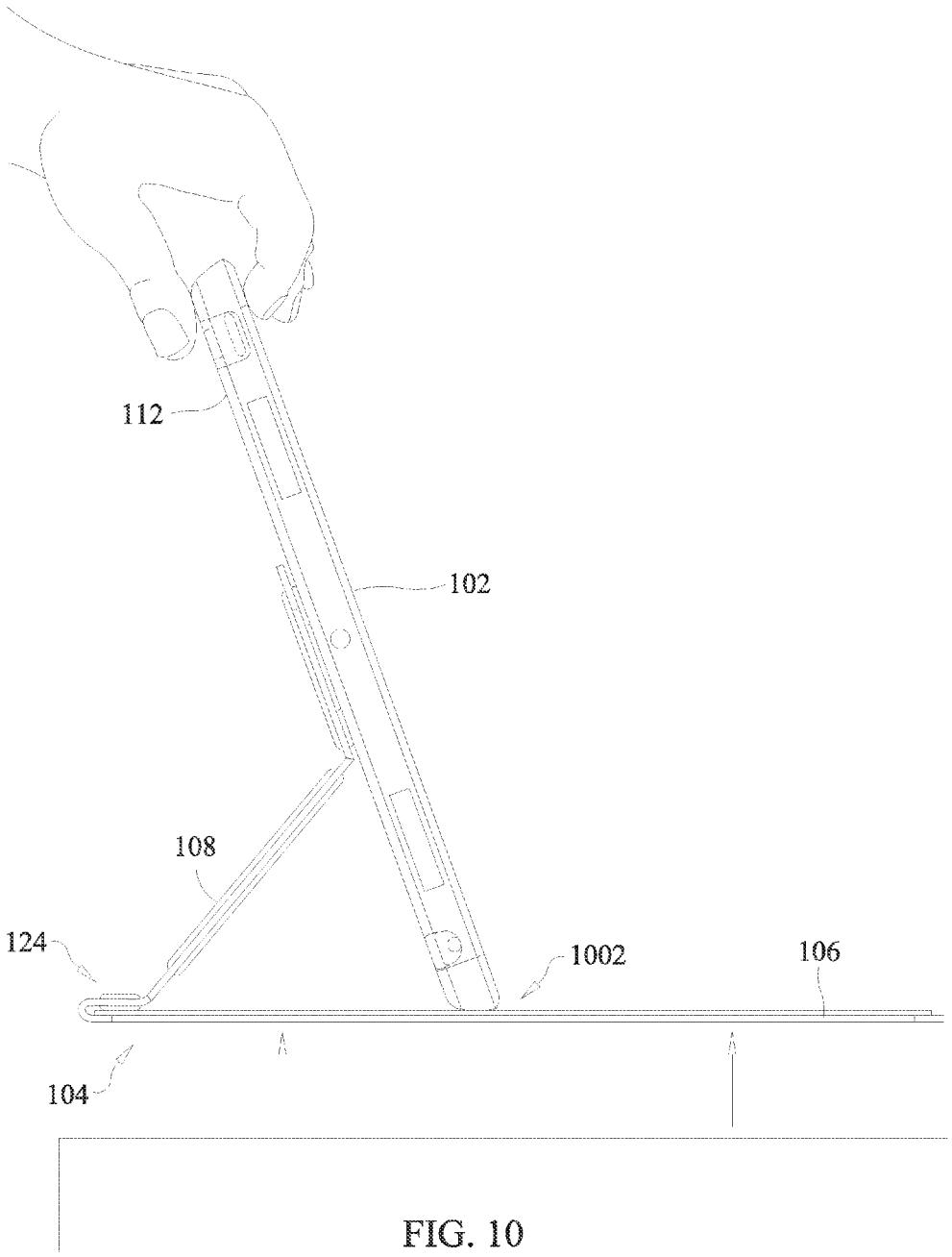
FIG. 10 is a perspective view showing how a user can raise an example portable electronic device equipped with a sample protective cover device situated in a viewing position while maintaining the integrity of the viewing position.

FIG. 10 is a perspective view showing how a user can raise an example portable electronic device 102 equipped with a sample protective cover device in a viewing position while maintaining the integrity of the viewing position, which is another of the numerous benefits the protective cover device 100 provides. FIG. 10 includes reference numerals corresponding to those used in at least FIGS. 1A-1C. For the purpose of brevity, the description of some of these elements is omitted. As shown, the edge of the back cover 112 is retained against the display protector 106 at point 1002 by the magnetic fasteners included in these components (not shown, but described elsewhere herein).

Figure 11A:
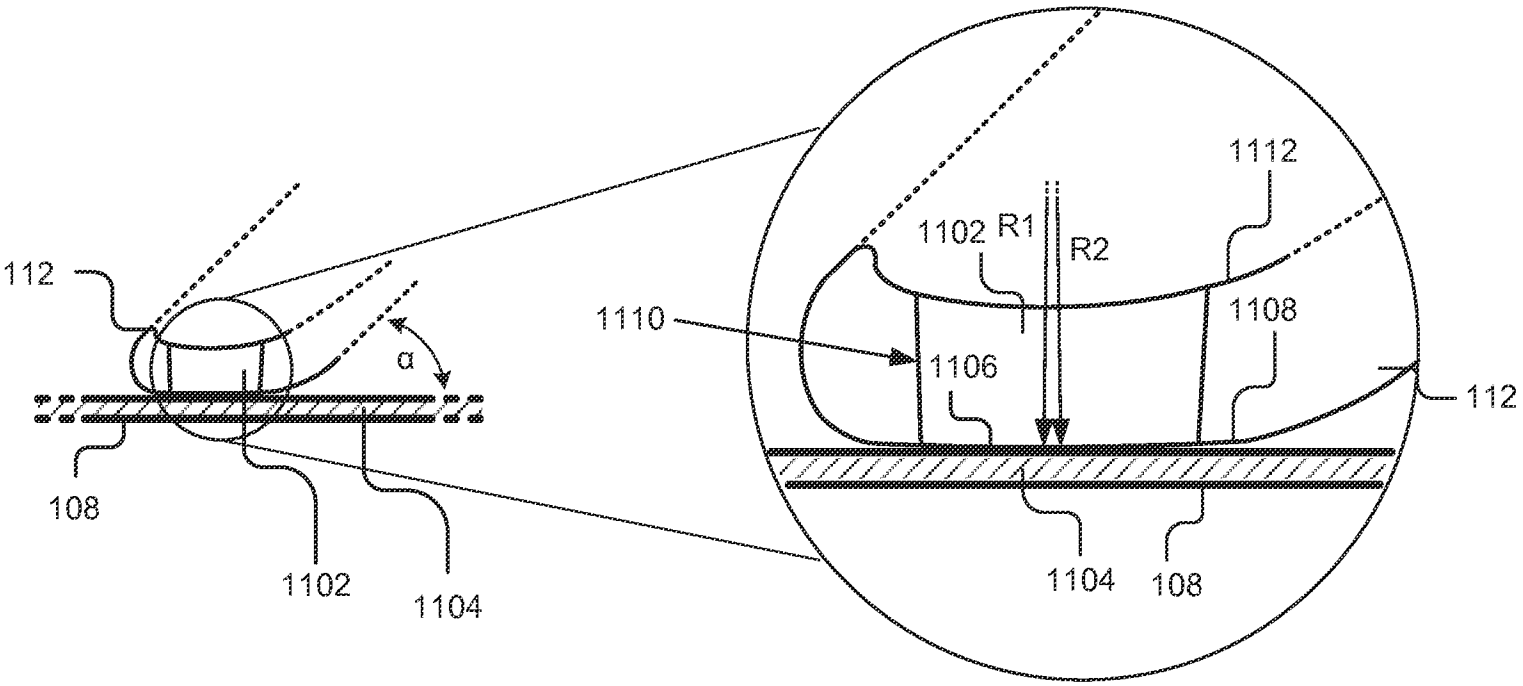
FIGS. 11A and 11B are schematic diagrams illustrating the configuration of example fastening components of an example protective cover device.
Figure 11B:
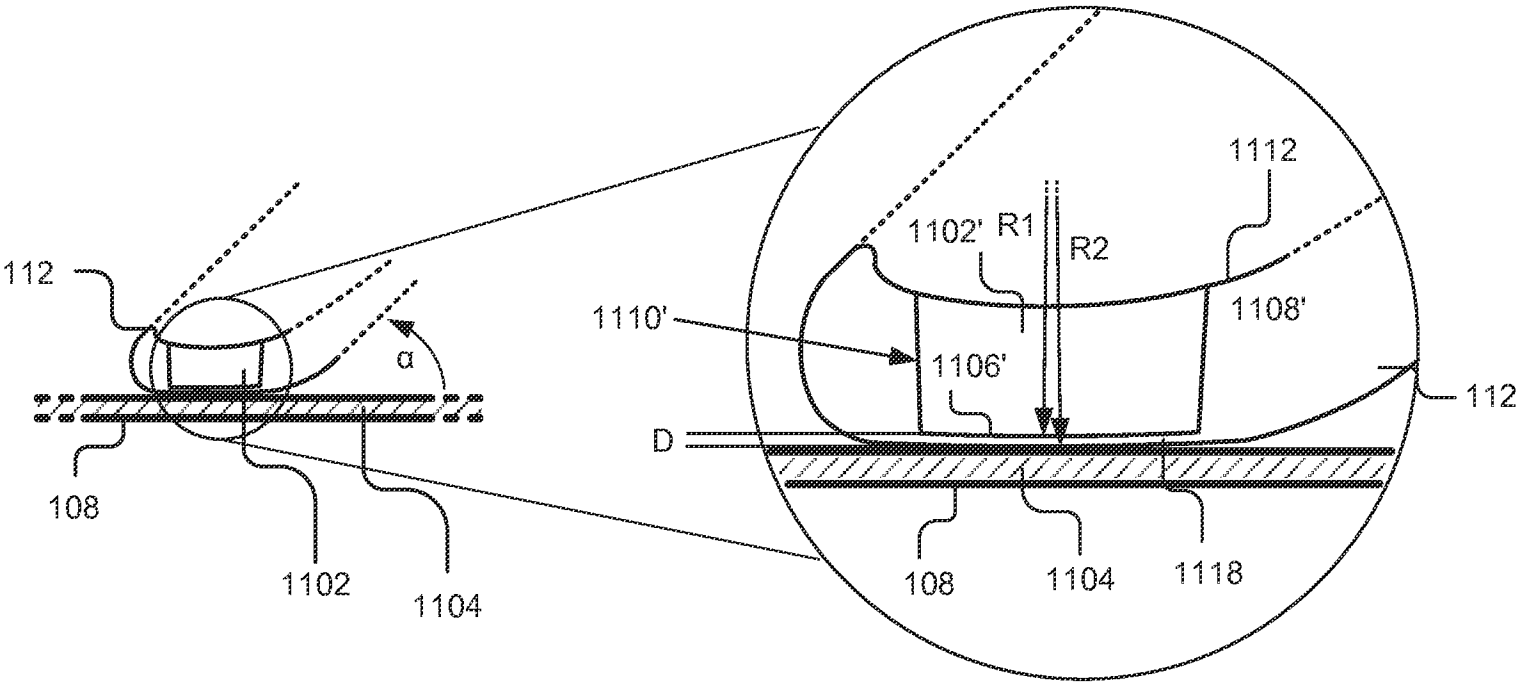

FIGS. 11A and 11B are schematic diagrams illustrating the configuration of example fastening components of an example protective cover device. In FIG. 11A, the magnet 1102 is configured to magnetically couple to a corresponding magnetic strip 1104 (e.g., a strip 208 discussed above with reference to at least FIG. 2A) embedded in an example display protector 106. The bottom surface of the magnet 1102 has a curvature that corresponds with the curvature of a bottom surface 1108 of the back cover 112. For instance, the radii R1 and R2, which respectively correspond to the curvature of the surfaces 1108 and 1106, may be substantially equivalent.

In this example, the surface 1106 is flush with and exposed through the surface 1108. The back cover 112 includes a tapered through-aperture 1110 extending through the back cover 112 (from an inner surface to the outer surface 1108). The opening of the through-aperture 1110 is wider on the end located proximal to the inner surface 1112 than on an end located proximal to the outer surface 1108, and the magnet 1102 is correspondingly shaped (tapered) to fit snugly in the through-aperture 1110. This is advantageous as it can prevent the magnet 1102 from inadvertently falling out of the back cover. While, in some cases, the magnet 1102 may be fixed in place (e.g., using a bracket on the inner-side, an adhesive applied to the through-aperture 1110, etc.), the tapered shape of the through-aperture 1110 and the magnet 1102 can still prevent the magnet 1102 from inadvertently falling out. On the inside, the outer surface of a portable electronic device 102 can prevent the magnet 1102 from falling out in the other direction (toward the inner cavity of the back cover 112), should the magnet 1102 be loosened.

Figure 12A:
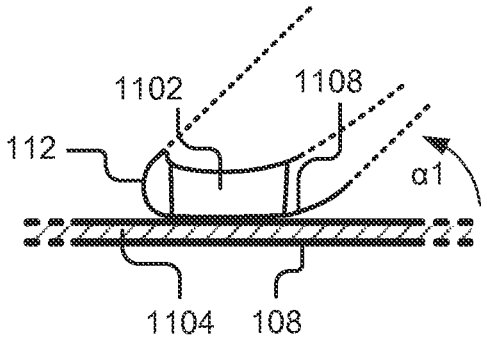
FIGS. 12A-12C are schematic diagrams illustrating the positioning of example fastening components of an example protective cover device.
Figure 12B:
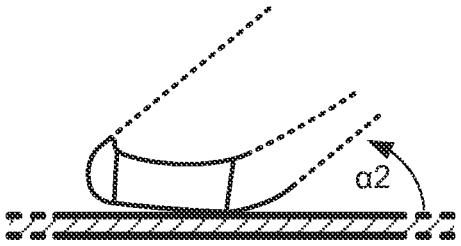
Figure 12C:
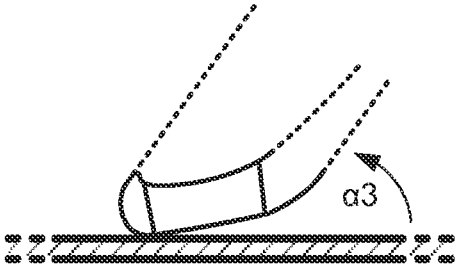

The depicted curvature of the surface 1106 is advantageous as it gives the back cover 112 a stealthy cosmetic appearance relative to the back cover 112. In addition, it situates the magnet 1102 as close as possible to the corresponding magnetic strip 1104 of the display protector 106 on which the edge of the back cover 112 rests so the position of the back cover 112 relative to the display protector 106 can be detachably locked in place by the magnet 1102 and the magnetic strip 1104 with the maximum amount of magnetic attraction for the angle $\alpha$ at which the back cover 112 is situated relative to the display protector 106. FIGS. 12A-C depict various different orientations of the magnet 1102 based on the angles $\alpha$1, $\alpha$2, and $\alpha$3, of the back cover 112 relative to the display protector 106. In these examples, regardless of the angle, a better magnetic bond can be achieved between the magnet 1102 and the magnetic strip 1104 because the magnet 1102 is situated flushly with the outer surface 1108 of the back cover 112. This also provides a pleasing, streamlined cosmetic appearance.

FIG. 11B includes a similar arrangement to that of FIG. 11A, with the exception of the aperture 1110', the magnet 1102', and the outer surface 1108'. In this embodiment, the aperture 1110' does not extend entirely through the side-wall of the back cover 112. Rather, the surface 1108' includes a portion 1118 that extends over the surface 1106' of the magnet 1102' to provide a monolithic cosmetic outer appearance. The thickness D of portion 1118 is thick enough to provide structural integrity to the back cover 112 while thin enough to provide sufficient magnetic attraction between the magnet 1102' and the magnetic strip 1104 included in the display protector 106 to detachably lock the back cover 112 in place.

FIGS. 12A-12C are schematic diagrams illustrating a process for positioning example fastening components of an example protective cover device, as discussed elsewhere herein.

Figure 13:
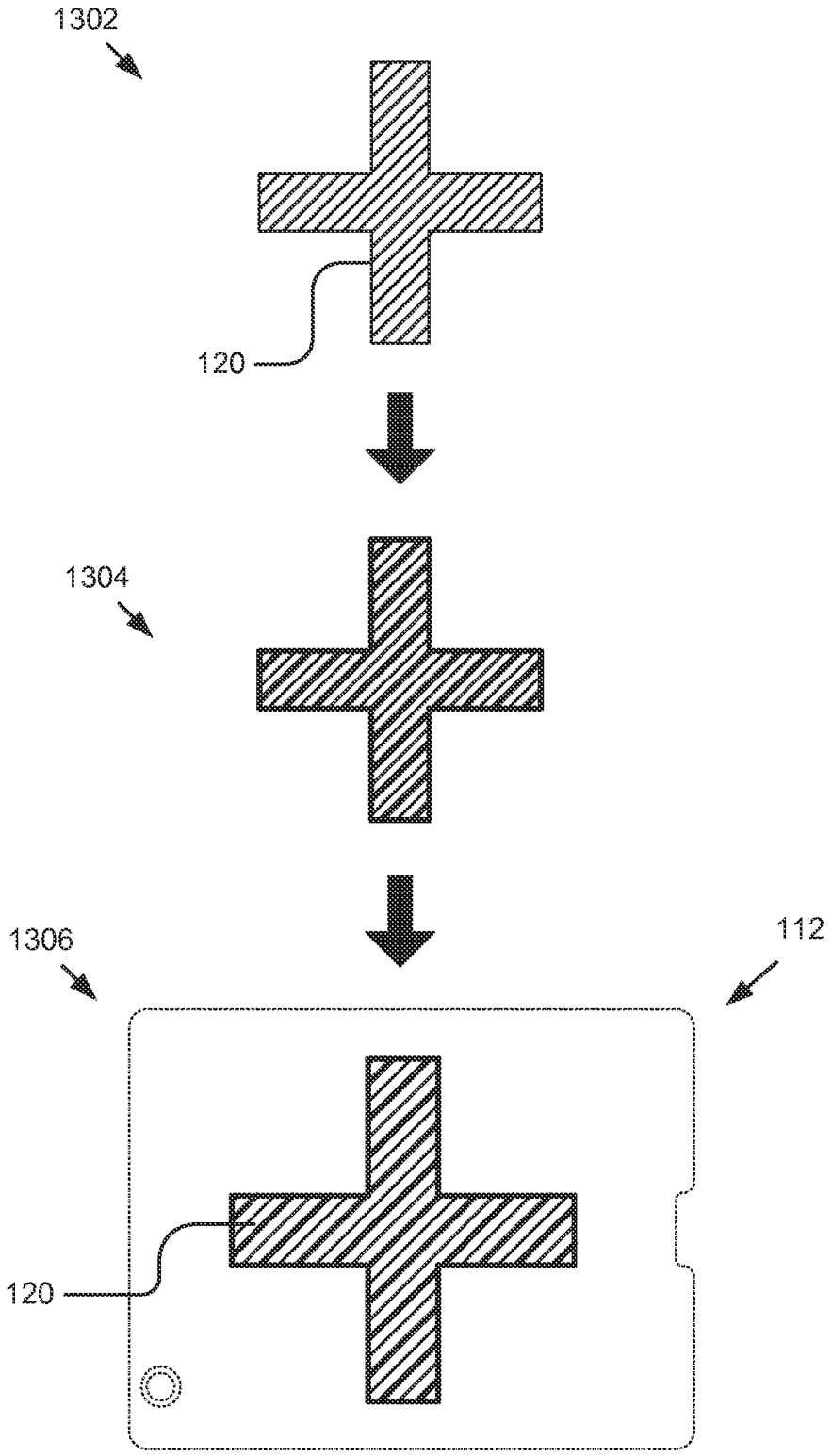
FIG. 13 is a schematic diagram of an example process for making and incorporating a magnetic component into an example protective cover device.

FIG. 13 is a schematic diagram of an example process for making and incorporating the magnetic component 120 into the protective cover device 100. As discussed elsewhere herein, the magnetic component 120 may be situated on a backside of the portable electronic device 102 (e.g., as part of the back cover 112, the portable electronic device 102, etc.). The flap 130 can magnetically detachable fasten to the magnetic component 120 and attachably slide along the surface of the magnetic component 120 to situate the display protector 106 in a desired position, as discussed elsewhere herein.

In the depicted embodiment, the magnetic component 120 is cross-shaped. However, it should be understood that other suitable shapes may be used, such as a rounded or polygonal shape. In operation 1302, the process produces a base magnetic component 120, such as a magnetic cross. For example, the cross may be comprised of a ferrous metal (e.g., steel) and may be produced using forging, cutting, grinding, polishing, stamping, pressing, milling, heat treating, tempering, and/or any other suitable metal-working technique. In another example, the cross may include one or more rare-earth magnets, which may be prepared using any conventional magnet-shaping techniques.

In operation 1304, the process coats the base magnetic component 120 with a texturized surface layer. In some embodiments, the process heat presses the base magnetic component 120 with thermoplastic polyurethane (TPU) or another suitable polymer. The TPU has a grippy surface texture that is configured to grip the corresponding magnetic component(s) included in the flap 130 of the display protector 106 (e.g., fastener 202) to prevent inadvertent slippage. In a further embodiment, to further increase the grip between the components 120 and 202, the process may also coat the fastener 202 in the same or a substantially similar way. For example, the fastening component 120 may include a rare earth magnet and the process may also coat the rare earth magnet with the same or similar texturized surface layer (e.g., TPU). The coated fastening component 202 may be included in a corresponding insert in the flap 130 (e.g., the tilt portion 118) on a side configured to face the coated magnetic component 120. By including the coating on both components, the grip force is further increase, thereby further reducing the probability of inadvertent slippage (e.g., during reposition of the back cover 112 relative to the display protector 106.).

In operation 1306, the magnetic component 120 may be incorporated into the back cover 112 or the portable electronic device 102, depending on the embodiment. In some cases, a correspondingly-shaped slot may be included in the back cover 112 or the portable electronic device 102, and the process may insert and secure the magnetic component 120 in the slot. The slot may recede (partially, completely through) into the outer surface of the back cover 112 or the portable electronic device 102. The process may use any conventional technique to secure the magnetic component 120, including, for example, adhesive, fasteners, brackets, groves, etc. In an embodiment where the slot extends completely through the wall of the back cover 112, this or a separate process may coat the inner cavity of the back cover 112 including the inner surface of the magnetic component 120 with a layer of material (not shown) to prevent the component from abrading the portable electronic device housed by it.

Figure 14:
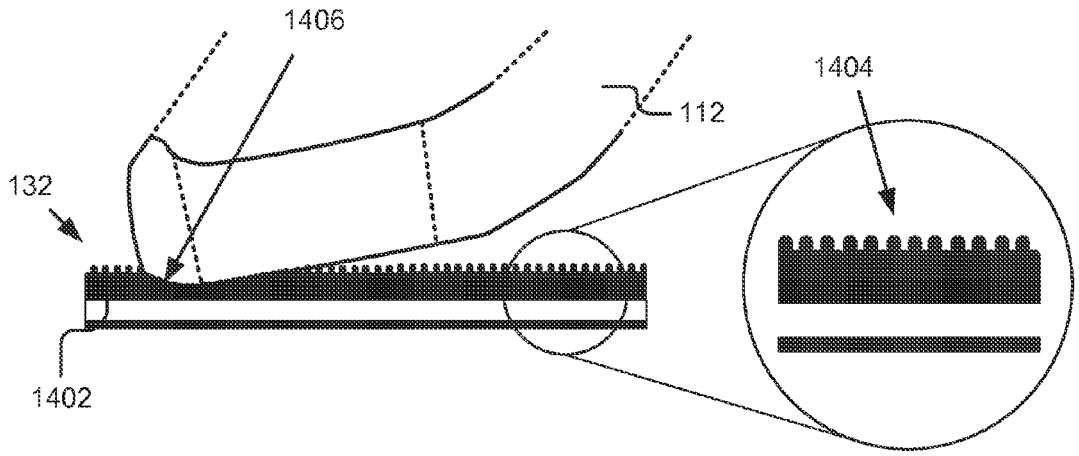
FIG. 14 is a side view of an example protective cover device being gripped by the material of the contact surface of an example display protector.

FIG. 14 is a side view of an example protective cover device 100 being gripped by the material of the contact surface of an example display protector 106. As shown, the contact surface 132 may include a non-scratching microfiber material 1402 suitable for protecting the display of the portable electronic device 102. The microfiber material 1402 may have a texturized surface configured to position and hold the edge 1406 of the portable electronic device 102 or the back cover 112. For instance, as shown, the contact surface 132 includes a material 1402 having a ribbed surface texture 1404 configured to grip an edge 1406 of the back cover 112. The edge 1406 can be incrementally adjusted forwards or backwards and slotted in between two adjacent ribs, and the fibers compressed under the edge 1406 may be suitably compressible to receive and hold the edge. This is beneficial as it can facilitate micro-adjustments to a viewing angle of the display of the portable electronic device 102 when propped up by the flap 130 and supported by the contact surface 132 of the display protector 106. It should be understood that in addition to, combination with, or in the place of a ribbed surface texture, the texturized surface of the microfiber material may include one or more of a tacky surface texture or other suitable gripping texture (e.g., stippled surface, etc.).

In addition to or in the place of the display cover component 104, in various embodiments, other accessories may be coupled to the back cover 112 to provide additional utility to the user experience. For instance, with reference to FIG. 4A, in the place of or in addition to the display cover component 104, using the same or another edge of the back cover 112 or portable electronic device 102, and/or using at least a portion of the magnetic component 120, etc., the user could detachably (e.g. magnetically) fasten a magnetic stylus, a magnetic detachable keyboard, a magnetic wall mount, a magnetic desktop mount, and/or other suitable accessories configured to couple to these fasteners (e.g., 402, 120, etc.).

In further embodiments, a method of using a protective device may include releasably attaching a display protector via a flap magnetically fastenable to a surface located on a back side of a portable electronic device; positioning the display protector in a protective position where the flap is located on a rear side of the portable electronic device and the display protector substantially covers a display located on a front side of the protective device; and articulating the display protector via the flap from the protective position to position underneath a first side of the portable electronic device so the flap and display protector cooperatively to prop up the portable electronic device in a landscape viewing position.

In these and other embodiments, the method may additionally or alternatively include the following operations and/or features: rotating the display protector via the flap from the first side of the portable electronic device to a second side of the portable electronic device that is substantially perpendicular to the first side and rotating the second side of the portable electronic device to a bottom-most orientation so the display protector and flap cooperatively prop up the portable electronic device in a portrait viewing position; articulating the display protector via the flap from the protective position to a position abutting and tangential to an uppermost side of the portable electronic device so the display protector and flap cooperative prop up the portable electronic device in a privacy viewing position; that the flap magnetically fastens to a central region of the surface; attaching a back cover to a rear side of the portable electronic device; that the back cover includes the surface and one or more first magnetic fasteners, the flap includes one or more second magnetic fasteners, and the flap magnetically fastens to the back cover via the first magnetic fasteners and second magnetic fasteners; that the first magnetic fasteners include a horizontal magnetic strip and a vertical magnetic strip in a cross formation; adjusting a fastening position of the flap by sliding the flap along the cross formation; and redirecting sound waves emitted rearward by the speaker forward toward a user of the portable electronic device.

In the foregoing description, for purposes of explanation, numerous specific details are set forth in order to provide a thorough understanding of the technology. It will be apparent, however, that the technology described herein can be practiced without these specific details. In other instances, structures and devices are shown in block diagram form in order to avoid obscuring the invention.

Reference in the specification to "one embodiment", "an embodiment", "some embodiments", or "other embodiments" means that a particular feature, structure, or characteristic described in connection with the embodiment is included in at least one embodiment of the disclosure. The appearances of the term "embodiment" or "embodiments" in various places in the specification are not necessarily all referring to the same embodiment.

In addition, it should be understood and appreciated that variations, combinations, and equivalents of the specific embodiments, implementations, and examples may exist, are contemplated, and are encompassed hereby. The invention should therefore not be limited by the above described embodiments, implementations, and examples, but by all embodiments, implementations, and examples, and other equivalents within the scope and spirit of the invention as claimed.

What is claimed is:

1. A protective cover device comprising:

a display protector that covers at least a portion of a display of a portable electronic device when applied to the portable electronic device and articulated to a protective position, the display protector further providing a contact surface to support the portable electronic device when articulated to a viewing position; and an articulating member connected proximate a first end of the display protector and propping up the portable electronic device when the display protector is articulated to the viewing position, the articulating member including at least one fastening component that is detachably fastenable to at least one compatible fastening component locatable on a backside of the portable electronic device, the display protector further including a fastening region extending along at least a portion of the contact surface, the fastening region being detachably coupleable with one or more compatible fastening components when the display protector is articulated to the viewing position, the one or more compatible fastening components being situated proximate a peripheral edge of the display or a back cover component for the portable electronic device.

2. The protective cover device of claim 1, further comprising the back cover component, the back cover component being configured to cover at least a portion of the backside of the portable electronic device, the back cover component including the at least one compatible fastening component to which the at least one fastening component of the articulating member is detachably fastenable.

3. The protective cover device of claim 2, wherein the at least one compatible fastening component includes an elongated surface to which the at least one fastening component of the articulating member is detachably fastenable, and the back cover component includes a surface that covers at least a portion of the backside of the portable electronic device when applied to the portable electronic device and includes the at least one compatible fastening component in a central region that corresponds to a central region of the portable electronic device.

4. The protective cover device of claim 3, wherein the elongated surface of the at least one compatible fastening component is one of cross-shaped, circular, and polygonal.

5. The protective cover device of claim 1, wherein the one or more compatible fastening components include at least one magnetic component situated along a first peripheral edge of the display or the back cover component and being magnetically coupleable with the one or more magnetic strips when the display protector is in a portrait orientation, and the one or more compatible fastening components include at least one magnetic component situated along a second peripheral edge of the display or back cover component and being magnetically coupleable with the one or more magnetic strips when the display protector is in a landscape orientation.

6. The protective cover device of claim 1, wherein, when in the viewing position, the protective cover device is capable of being further situated in a privacy position by rotating the protective cover device counter clockwise substantially 90° as measured between a horizontal reference surface and the display protector and turning the protective cover device substantially 180° about an axis perpendicular to the horizontal reference surface.

7. The protective cover device of claim 1, wherein the fastening region comprises one or more of one or more magnets, a magnetic coating, one or more nano-suction components, and one or more friction-based male or female fasteners.

8. The protective cover device of claim 1, wherein the at least one fastening component of the articulating member and the at least one compatible fastening component are magnetic.

9. The protective cover device of claim 1, wherein the fastening region and the one or more compatible fastening components are magnetic.

10. A method for making a protective cover device that includes a display protector that covers at least a portion of a display of a portable electronic device when applied to the portable electronic device and articulated to a protective position, the display protector further providing a contact surface to support the portable electronic device when articulated to a viewing position; and an articulating member connected proximate a first end of the display protector and propping up the portable electronic device when the display protector is articulated to the viewing position, the articulating member including at least one fastening component that is detachably fastenable to at least one compatible fastening component locatable on a backside of the portable electronic device, the display protector further including a fastening region extending along at least a portion of the contact surface, the fastening region being detachably coupleable with one or more compatible fastening components when the display protector is articulated to the viewing position, the one or more compatible fastening components being situated proximate a peripheral edge of the display or a back cover component for the portable electronic device.

11. A protective cover device comprising:

a flap that is detachably fastenable to a surface located on a backside of a portable electronic device; and a display protector connected to the flap proximate a first end of the display protector and being positionable in a protective position to cover at least a portion of a display of the portable electronic device when applied to the portable electronic device, the display protector being articulatable to a position underneath a first side of the portable electronic device in which the flap and the display protector cooperatively prop up the portable electronic device in a first viewing position and including a fastening region extending along at least a portion of a contact surface of the display protector, the fastening region being coupleable with one or more compatible fastening components when the display protector is articulated to the first viewing position, the one or more compatible fastening components being situated proximate a peripheral edge of the display or a back cover component for the portable electronic device.

12. The protective cover device of claim 11, wherein the display protector is rotatable via the flap from the first side of the portable electronic device to a second side of the portable electronic device that is substantially perpendicular to the first side so the display protector and flap cooperatively prop up the portable electronic device in a second viewing position, the first viewing position being a landscape viewing position and the second viewing position being a portrait viewing position.

13. The protective cover device of claim 11, wherein the display protector is articulatable via the flap from the protective position to a position abutting and tangential to an uppermost side of the portable electronic device so the display protector and flap cooperatively prop up the portable electronic device in a privacy viewing position.

14. The protective cover device of claim 11, wherein the flap includes a magnetic component that magnetically detachably fastens to a central region of the surface.

15. The protective cover device of claim 11, further comprising:

a back cover attachable to a backside of the portable electronic device, the back cover including the surface, the surface including one or more first magnetic components, the flap including one or more second magnetic components, the flap being detachably magnetically fastenable to the back cover via the first magnetic components and second magnetic components.

16. The protective cover device of claim 15, wherein the contact surface is configured to support a peripheral edge of the back cover, the display protector includes one or more magnetic strips extending along the contact surface, and the one or more compatible fastening components situated along a peripheral edge of the display includes one or more compatible magnetic components situated along two or more peripheral edges of the back cover in a manner that allows the one or more compatible magnetic components included in the back cover to magnetically detachably fasten to the one or more magnetic strips included in the display protector.

17. The protective cover device of claim 11, wherein the surface forms the backside of the portable electronic device, the surface includes one or more first magnetic components, the flap includes one or more second magnetic components, and the flap detachably magnetically fastens to the portable electronic device via the first magnetic components and second magnetic components.

18. The protective cover device of claim 11, wherein the display protector includes one of a keyboard, a stylus, a wall mount, and a desktop mount.

* * * * *